US011313168B2

(12) United States Patent
Virgin

(10) Patent No.: US 11,313,168 B2
(45) Date of Patent: Apr. 26, 2022

(54) UNIVERSAL ADD-ON DEVICES FOR FEATURE ENHANCEMENT OF OPENERS FOR MOVABLE BARRIERS

(71) Applicant: William Kyle Virgin, Galena, OH (US)

(72) Inventor: William Kyle Virgin, Galena, OH (US)

( * ) Notice: Subject to any disclaimer, the term of this patent is extended or adjusted under 35 U.S.C. 154(b) by 1 day.

(21) Appl. No.: 16/731,352

(22) Filed: Dec. 31, 2019

(65) Prior Publication Data

US 2020/0208461 A1 Jul. 2, 2020

Related U.S. Application Data

(60) Provisional application No. 62/786,621, filed on Dec. 31, 2018.

(51) Int. Cl.

| | |
|---|---|
| ***E06B 7/00*** | (2006.01) |
| ***E05F 15/77*** | (2015.01) |
| ***E05F 15/668*** | (2015.01) |
| ***E05F 15/71*** | (2015.01) |
| ***E05F 15/72*** | (2015.01) |

(52) U.S. Cl.

CPC ..... *E05F 15/77* (2015.01); *E05F 15/668* (2015.01); *E05F 15/71* (2015.01); *E05F 15/72* (2015.01); *E05Y 2400/44* (2013.01); *E05Y 2400/85* (2013.01); *E05Y 2900/106* (2013.01)

(58) Field of Classification Search

CPC ..... E05F 15/668; E05F 15/72; E05F 15/77; E05F 15/71; E05Y 2400/612; E05Y 2201/22; E05Y 2900/106; E05Y 2400/40; E05Y 2400/814; E05Y 2400/818; E05Y 2400/44; E05Y 2400/32; E05Y 2400/85; E05Y 2400/81; G07C 9/00309; G07C 2009/00928

USPC .. 49/70, 13, 324, 335, 28, 26, 27, 197, 199, 49/31, 200

See application file for complete search history.

(56) References Cited

U.S. PATENT DOCUMENTS

| | | | | |
|---|---|---|---|---|
| 4,197,675 | A | 4/1980 | Kelly | |
| 5,576,739 | A | 11/1996 | Murphy | |
| 5,752,343 | A | 5/1998 | Quintus | |
| 6,414,587 | B1 * | 7/2002 | Fitzgibbon ..... | G07C 9/00182 340/12.29 |
| 6,476,732 | B1 | 11/2002 | Stephen | |

(Continued)

*Primary Examiner* — Chi Q Nguyen

(74) *Attorney, Agent, or Firm* — Porter, Wright, Morris & Arthur, LLP

(57) ABSTRACT

A universal add-on device for controlling a movable barrier opener to open and close a movable barrier includes a control module which wirelessly communicates with a user's mobile electronic device. The opener includes a hand-held remote transmitter having a push-button switch. The hand-held remote transmitter is configured to transmit wireless signals to the opener for initiating the opener to move the movable barrier upon actuation of a push button of the push-button switch. The control module is either connected to an actuator to physically actuate the push-button switch of the hand-held remote transmitter or electrically connected in parallel with the push-button switch to electrically actuate the push-button switch of the hand-held remote transmitter. The device enables a manufacturer's compatible remote transmitter or a universal remote transmitter to be utilized to control the movable barrier using the user's mobile electronic device such as a smart phone.

12 Claims, 19 Drawing Sheets

(56) References Cited

U.S. PATENT DOCUMENTS

| | | | | |
|---|---|---|---|---|
| 7,183,732 | B2 * | 2/2007 | Murray | E05F 15/668 318/280 |
| 7,183,933 | B2 | 2/2007 | Dzurko et al. | |
| 7,710,284 | B2 | 5/2010 | Dzurko et al. | |
| 8,643,467 | B2 | 2/2014 | Chutorash et al. | |
| 8,669,878 | B1 | 3/2014 | Vantiburg | |
| 9,053,626 | B2 | 6/2015 | Christoforo | |
| 9,122,254 | B2 | 9/2015 | Cate et al. | |
| 9,141,099 | B2 | 9/2015 | Cate et al. | |
| 9,177,430 | B2 | 11/2015 | Fitzgibbon et al. | |
| 9,217,272 | B2 * | 12/2015 | Phillips | E05F 15/72 |
| 9,217,283 | B2 * | 12/2015 | Olmsted | E06B 9/80 |
| 9,376,851 | B2 | 6/2016 | Cate et al. | |
| 9,507,335 | B2 | 11/2016 | Wilder et al. | |
| 9,644,416 | B2 | 5/2017 | Fitzgibbon et al. | |
| 9,836,905 | B2 | 12/2017 | Chutorash et al. | |
| 9,870,664 | B2 | 1/2018 | Wilder et al. | |
| 9,896,877 | B2 | 2/2018 | Fitzgibbon et al. | |
| 9,978,265 | B2 | 5/2018 | McNabb et al. | |
| 10,015,898 | B2 | 7/2018 | Whitmire et al. | |
| 10,096,187 | B2 | 10/2018 | Deneen et al. | |
| 10,126,737 | B2 | 11/2018 | Fitzgibbon | |
| 10,127,806 | B2 | 11/2018 | McNabb et al. | |
| 10,138,671 | B2 | 11/2018 | Fitzgibbon et al. | |
| 10,713,869 | B2 * | 7/2020 | Morris | E05F 15/668 |
| 10,950,111 | B2 * | 3/2021 | Baker | H01Q 1/2208 |
| 10,997,810 | B2 * | 5/2021 | Atwell | G07C 9/00817 |
| 11,074,773 | B1 * | 7/2021 | Morris | B60L 53/66 |
| 11,220,856 | B2 * | 1/2022 | Axtolis | G07C 9/00857 |
| 2006/0202815 | A1 | 9/2006 | John | |
| 2012/0260575 | A1 | 10/2012 | Monaco | |
| 2014/0266589 | A1 * | 9/2014 | Wilder | G07C 9/00817 340/5.64 |
| 2015/0096693 | A1 * | 4/2015 | Fitzgibbon | E05F 15/42 160/7 |
| 2015/0222517 | A1 * | 8/2015 | McLaughlin | H04W 12/50 713/156 |
| 2015/0268210 | A1 | 9/2015 | Cristoforo | |
| 2015/0275564 | A1 | 10/2015 | Rosenthal et al. | |
| 2016/0117879 | A1 | 4/2016 | Chutorash et al. | |
| 2017/0198516 | A1 | 7/2017 | Dey et al. | |
| 2018/0209199 | A1 * | 7/2018 | Liu | F21V 33/006 |
| 2018/0264299 | A1 | 9/2018 | Combe | |
| 2018/0266163 | A1 | 9/2018 | Combe | |
| 2018/0349242 | A1 * | 12/2018 | Mathews | H04W 12/50 |
| 2019/0043290 | A1 * | 2/2019 | Morris | G07C 9/00309 |
| 2020/0043270 | A1 * | 2/2020 | Cate | G07C 9/00571 |
| 2020/0098215 | A1 * | 3/2020 | Hawkins | H04L 9/32 |
| 2020/0208461 | A1 * | 7/2020 | Virgin | E05F 15/72 |
| 2020/0242862 | A1 * | 7/2020 | Cate | H04W 4/021 |
| 2020/0291714 | A1 * | 9/2020 | Baer | E05F 15/668 |

* cited by examiner

UNIVERSAL ADD-ON DEVICES FOR FEATURE ENHANCEMENT OF OPENERS FOR MOVABLE BARRIERS

CROSS-REFERENCE TO RELATED APPLICATIONS

This application claims the priority benefit of U.S. Provisional Application No. 62/786,621 filed on Dec. 31, 2018, the disclosure of which is expressly incorporated herein in its entirety by reference.

STATEMENT REGARDING FEDERALLY SPONSORED RESEARCH

Not Applicable

PARTIES TO A JOINT RESEARCH AGREEMENT

Not Applicable

REFERENCE TO APPENDIX

Not Applicable

FIELD OF THE DISCLOSURE

The field of the disclosure generally relates to movable barriers such as garage doors, roll-up doors, gates, and the like and, more particularly, to remote control and/or monitoring of the movable barriers.

BACKGROUND

Movable barriers such as, for example but not limited to, residential and commercial garage doors, residential and commercial rollup doors, slidable and swingable gates, and the like are used to selectively allow and restrict entry into and exit from building structures and property. These movable barriers are driven between their respective open and closed positions by powered moving units or openers coupled to the movable barrier. In the specific case of residential garage doors, these powered moving units are typically referred to as garage door openers or operators.

As best shown in FIG. 1, a typical residential garage door opener or operator 10 is designed for moving a sectional garage door 12 between its open and closed positions. The opener 10 includes a central control unit having a microcontroller for (i) processing incoming user-actuated door instructions and (ii) generating output control signals corresponding to these instructions, a motor controller for receiving the output control signals from the microcontroller and transmitting the output control signals to a motor, and a DC or AC motor drivingly coupled to the garage door 12. The user-actuated door instructions are in the form of wired or wireless signals transmitted to the microcontroller from interior or exterior mounted wall consoles 14 or from hand-held or vehicle-mounted RF remote transmitters 16.

With the proliferation of electronic devices and equipment designed to access the Internet such as, for example but not limited to, personal computers, tablets, and smartphones, and the like, there are many systems currently available that enable non-proximate or remote monitoring and control, via the Internet, of a variety of home appliances, building doors, and the like. For example, a homeowner that is not in close proximity to their residence can use one of these systems to determine whether their garage door is closed as intended, or whether the garage door is open as intended, through access over the Internet. Additionally, if the garage door is not in the desired position, these systems also enable the homeowner to transmit instructions over the Internet to move the garage door to the desired position, all without having to be physically proximate to the garage to do so.

Smart garage door openers are currently available that are Wi-Fi enabled to connect the openers to a network such as the Internet. Users can utilize an application on their mobile devices to receive alerts, monitor garage door status, and remotely control the garage door openers. Such smart garage door openers are available from at least the Chamberlain Group, the Genie Company, and Ryobi Limited. While these smart garage door openers can provide very desirable features to homeowners, most garage doors already have a garage door opener installed thereto. Garage door openers are fairly simple mechanisms that tend to last a long time. The average lifespan for a garage door opener is about 10 to 15 years, but if well maintained, it's common to be as much as 20 years or more. Many homeowners may desire the features of a smart garage door opener but do not want to replace a "good" garage door operator due to cost.

Add-on wireless Wi-Fi-enabled hubs for garage door openers are also currently available which can add additional smart features to "non-smart" garage door openers. Such as, for example but not limited to, MyQ garage door opener hub available from the Chamberlain Group, and Aladdin Connect available from the Genie Company. These add-on hubs are only compatible with openers of the respective manufacturer and the manufacturers typically advertise that the hubs are compatible with most garage door openers manufactured after 1993. Because they are not compatible with all garage door openers, many homeowners still cannot add smart features without purchasing a new garage door opener. Additionally, even when "compatible" it can be difficult and time consuming to establish the required connection between the add-on hub and the garage door opener.

Accordingly, there is a need in the art for universal add-on devices for feature enhancement of previously-installed openers for movable barriers.

SUMMARY OF THE DISCLOSURE

Disclosed are universal add-on devices for feature enhancement of movable barrier openers which address one or more issues of the related art. A device for controlling a movable barrier opener to open and close a movable barrier includes an actuator and a control module. The opener includes a hand-held remote transmitter having a push-button switch configured to selectively transmit wireless signals to the opener for initiating the opener to move the movable barrier upon actuation of a push button the push-button switch. The actuator is configured to selectively press the push-button of the hand-held remote transmitter. The control module is operably connected to the actuator to selectively initiate the actuator to press the push-button of the hand-held remote transmitter to move the movable barrier.

Also disclosed is a system for controlling a movable barrier opener that opens and closes a movable barrier comprising a hand-held remote transmitter, an actuator and a control module. The hand-held remote transmitter has a push-button switch configured to selectively transmit wireless signals to the opener for initiating the opener to move the movable barrier upon actuation of a push button of the push-button switch. The actuator is configured to selectively press the push-button of the hand-held remote transmitter. The control module is operably connected to the actuator to selectively initiate the actuator to press the push-button of the hand-held remote transmitter to move the movable barrier.

Further disclosed is a system for controlling a movable barrier opener that opens and closes a movable barrier comprising a hand-held remote transmitter and a control module. The hand-held remote transmitter has a push-button switch configured to selectively transmit wireless signals to the opener for initiating the opener to move the movable barrier upon actuation of a push button of the push-button switch. A control module is operably connected with a wired connection to the hand-held remote transmitter in parallel with the push-button for selectively activating the push button switch of hand-held remote transmitter with the control module to selectively transmit wireless signals to the opener for initiating the movable barrier opener to move the movable barrier without activating the push button of the push-button switch.

From the foregoing disclosure and the following more detailed disclosure it will be apparent to those skilled in the art that this disclosure provides a significant advance in the technology and art of add-on devices for feature enhancement of movable barrier openers. Particularly significant in this regard is the potential that the devices and methods of this disclosure affords for being universal, that is, adding features to any movable barrier opener on the market, and doing so at in a relatively easy and inexpensive manner. Additional features and advantages of various disclosed embodiments will be better understood in view of the detailed description provided below.

BRIEF DESCRIPTION OF THE DRAWINGS

These and further features of the disclosure will be apparent with reference to the following description and drawings.

Figure 1:
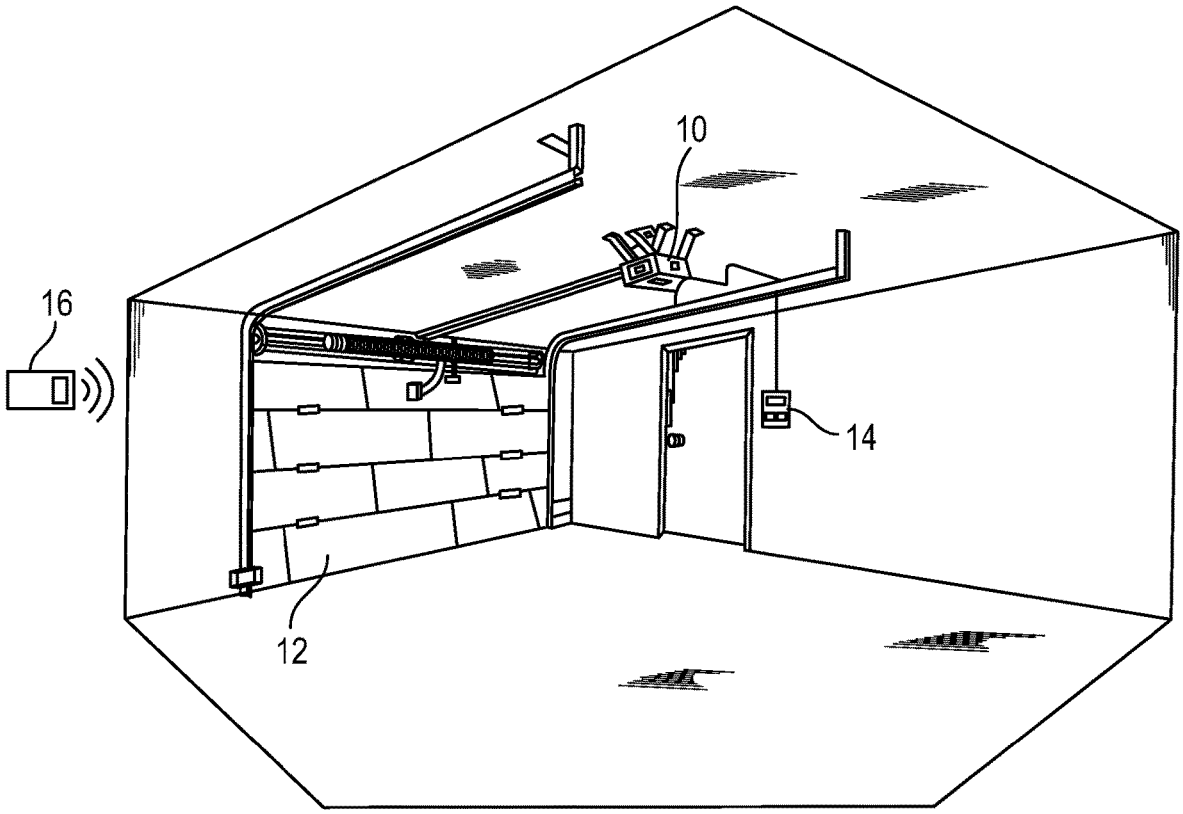
FIG. 1 (Prior Art)
FIG. 1 is a perspective view of a prior-art residential garage door opener or operator installed on a residential garage door.

It should be understood that the appended drawings are not necessarily to scale, presenting a somewhat simplified representation of various preferred features illustrative of the basic principles of the disclosure. The specific design features of the universal add-on devices for feature enhancement of movable barrier openers as disclosed herein, including, for example but not limited to, specific dimensions, orientations, locations, and shapes of the various components, will be determined in part by the particular intended application and use environment. Certain features of the illustrated embodiments have been enlarged or distorted relative to others to facilitate visualization and clear understanding. In particular, thin features may be thickened, for example but not limited to, for clarity or illustration. All references to direction and position, unless otherwise indicated, refer to the orientation of the structures illustrated in the drawings.

DETAILED DESCRIPTION OF CERTAIN EMBODIMENTS

It will be apparent to those skilled in the art, that is, to those who have knowledge or experience in this area of technology, that many uses and design variations are possible for the universal add-on devices for feature enhancement of movable barrier openers disclosed herein. The following detailed discussion of various alternative and preferred embodiments will illustrate the general principles of the disclosure using exemplar universal add-on devices for feature enhancement of garage door openers or operators. Other embodiments suitable for other applications will be apparent to those skilled in the art given the benefit of this disclosure.

Figure 2:
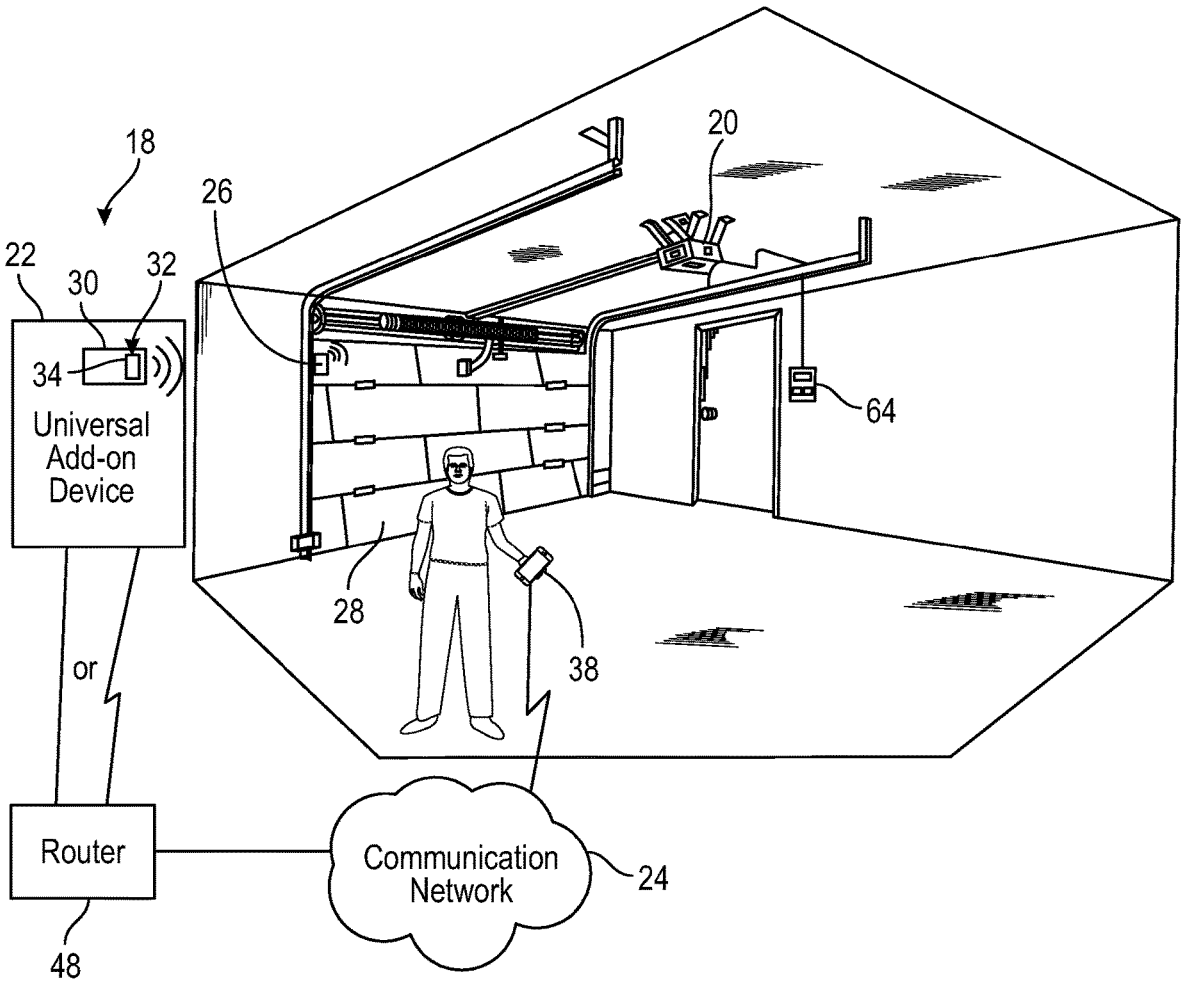
FIG. 2 is a diagrammatic view of a universal add-on system for controlling a garage door opener or operator installed to a garage door.
Figure 3:
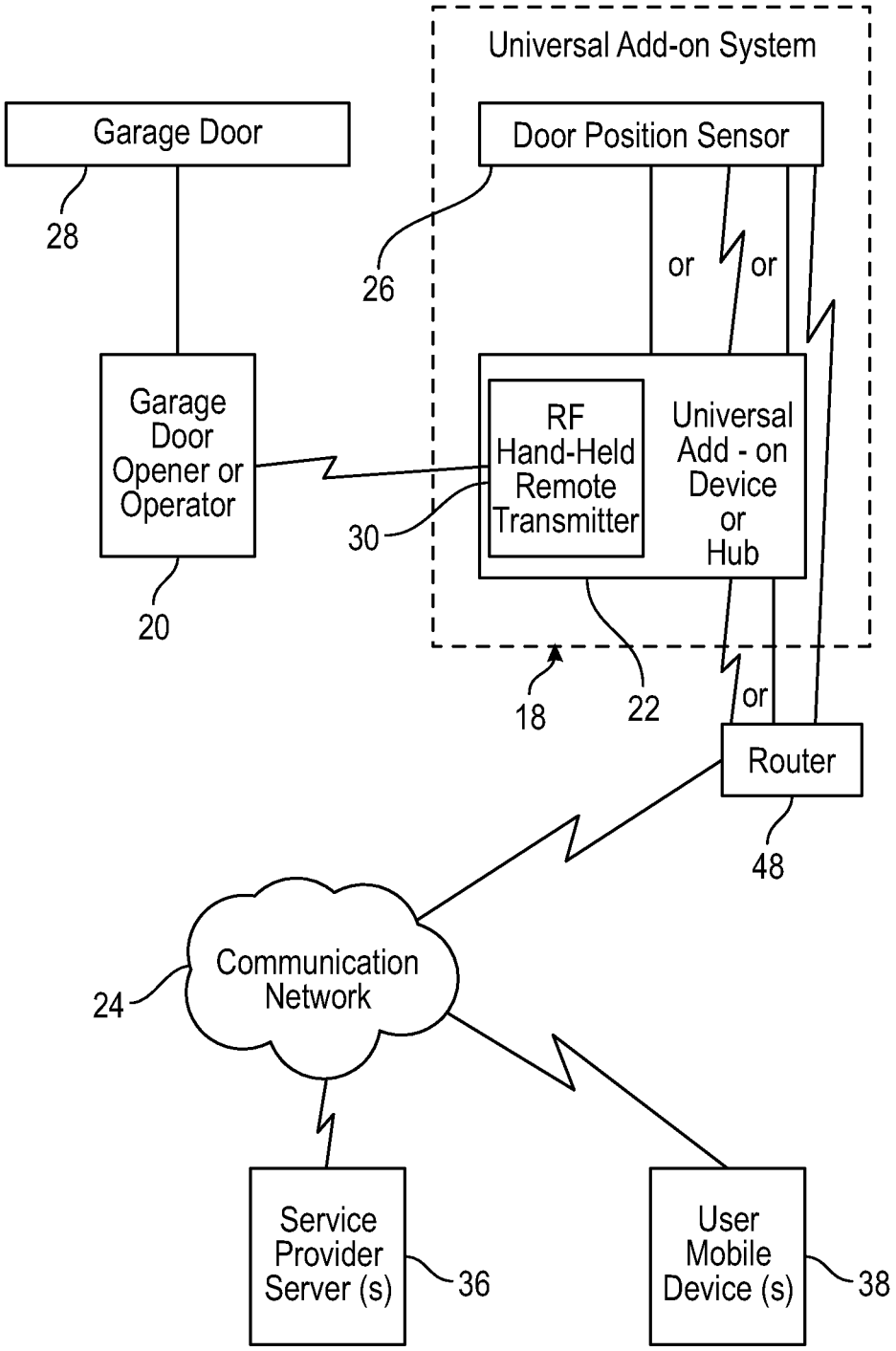
FIG. 3 is a schematic view of the universal add-on system of FIG. 2 installed to the garage door opener or operator.

Referring now to the drawings, FIGS. 2 and 3 illustrate an Internet-based universal add-on system 18 for feature enhancement of one or more movable barrier openers or operators 20 such as, for example but not limited to, a residential garage door opener or operator. The illustrated universal add-on system 18 includes an add-on main module or device 22 in communication with a suitable communication network 24 and at least one door position detector or sensor 26 positioned sufficiently proximate to a garage door 28 to monitor open and closed door status of the garage door 28. The illustrated add-on device 22 is in communication with the door position sensor 26 for receiving the open and closed door status of the garage door 28 from the door position detector. The illustrated add-on device is also operably connected to a RF hand-held remote transmitter 30 is configured to wirelessly transmit signals to the garage door opener 20 for enabling actuation of the garage door opener 20 to change the open and closed door status of the garage door 28.

The illustrated RF hand-held remote transmitter 30 is configured to be in wireless communication with the garage door opener 20 via the communications protocol used by the garage door opener 20. The RF hand-held remote transmitter 30 can be the original hand-held remote transmitter obtained with the garage door opener 20, a replacement hand-held remote transmitter obtained from the original manufacturer of the garage door opener 20 for the specific model of the garage door opener 20, or a universal remote programmed to communicate with the garage door opener 20. The use of these transmitters enables the add-on device 22 to be truly universal. That is, the add-on device 22 can be used to enhance all garage door openers 20 that utilize a hand-held remote transmitter 30. The illustrated RF hand-held remote transmitter 30 is of the type having at least one push-button switch 32 having a push button 34 which is physically actuated or pushed by the user to open and close the garage door 28. While the illustrated hand-held remote transmitter 30 is an RF type transmitter, it is noted that any other suitable type of remote transmitter that communicates with the garage door opener 20 can alternatively be utilized.

The illustrated add-on device 22 is also in wireless communication with a computer or server 36 of a service provider via the communication network 24 such as, for example but not limited to, the Internet, and the like. The illustrated service provider server 36 is configured to receive and/or store information representing the open and closed door status of the garage door 28 received from the universal add-on device 22 and any other suitable information for records and/or selective transmission to a portable or mobile electronic device 38 of a garage door user. The illustrated service provider server 36 is also configured to receive and/or store information representing open and close instructions for the garage door 28 received from the user mobile electronic device 38 and any other suitable information for records and/or selective transmission to the add-on device 22. The mobile electronic device 38 of the user is provided with a mobile application or "app" configured to communicate with software residing on the service provider server 36 or other suitable location. Thus, the user can use their mobile electronic device 38 to both monitor the open/closed status of the garage door 28 as well as remotely change the open and closed status of the garage door 28. Additional features can also be added if desired as described hereinbelow. The term "server" is used in the specification and claims to mean a computer configured to manage, store, send and process data 24-hours a day. The term "computer" is used in the specification and claims to mean any electronic device that can suitably communicate via a computer network including, but not limited to, desktop computers, laptop computers, notebook computers, tablet computers, smart phones, personal digital assistants (PDAs), digital cameras, mp3 players, video game systems, messaging systems, video players, smart televisions, and the like. The terms "portable electronic device" and "mobile electronic device" are used in the specification and claims to mean a handheld electronic device that utilizes rechargeable batteries as a power source and that that can suitably communicate with the service provider server via the communication network including, but not limited to, smart phones, personal digital assistants (PDAs), mp3 or other music players, video game players, messaging systems, tablet computers, notebook computers, and the like.

The illustrated universal add-on device 22, the illustrated service provider server 36, and the illustrated user mobile electronic device(s) 38 are in electronic communication with one another via the communication network 24. The illustrated communication network 24 is a computer network such as, for example but not limited to, the Internet but any other suitable communication network or system can alternatively be utilized such as, for example but not limited, an intranet, any other type network of computers, and the like.

The illustrated service provider server 36 is located at the service provider or other suitable location remote from the garage door 28 and can be accessed by via the communication network 24. In many instances the service can be cloud based. It is noted that while software is provided by the service provider as software as a service (SaaS), the software can alternatively be provided in any other suitable manner. It is noted that the SaaS can also be used on the mobile app side with "In App Purchases" on the mobile device to enable software features into the mobile app when a customer wants to purchase additional features. A "Bundle Pack" can also be purchased for multiple features. The system software or web platform resides at the service provider server 36 and is accessible to the user via a mobile application dashboard or home page on the user's mobile electronic device 38. It is noted that that while the illustrated add-on system 18 shows a single service provider server 36, it should be appreciated that there is typically more than one service provider server 36.

The illustrated service provider server 36 preferably includes memory, at least one processor or central processing units (CPU) in communication with the memory, one or more input/output (IO) interfaces 30 in communication with the processor, and at least one network interface in communication with the processor, all of which is configured to carry out the functions and steps described herein. The illustrated memory stores data files, an operating system (OS), host applications for communications with web browsers and mobile applications, security applications for limiting access to authorized users, and a database management system for interfacing with databases having stored information. It is noted that any other suitable information and/or software can be stored in the processor and/or the memory. The illustrated databases are separate from the service provider server or computer but it is noted that the databases can alternatively be integrated with the service provider server or computer. The illustrated databases are located at the service provider and/or a cloud location but it is noted that the databases can alternatively be located at any other suitable location and/or be of any other suitable type. The illustrated databases include a transaction database and a security database but any other suitable types of databases can alternatively or additionally be utilized. The at least one processor can be of any suitable type. The at least one IO interface can be of any suitable type such as a keyboard, a mouse, a track ball, a touch pad, a camera, a speaker, a monitor, a printer, a modem, a disk drive and the like. The network interface can be of any suitable type such as, for example but not limited to, a network interface card, software simulating a network card, and the like. The illustrated processor and memory are programmed with computer software for facilitating the function described herein including providing a web portal for interfacing with the user's mobile electronic device(s) 38 as described in more detail hereinafter.

The illustrated user mobile electronic device(s) is physically located with the user whether they are located near or remote from the garage door 28. It is noted that that while the illustrated system 18 shows a single user having a single mobile electronic device 38, it should be appreciated that there is typically more than one user having more than one mobile electronic device 38.

The illustrated user mobile electronic device 36 includes memory, at least one processor or central processing units (CPU) in communication with the memory, one or more input/output (IO) interfaces in communication with the processor, and at least one network interface in communication with the processor, all of which is configured to carry out the functions and steps described herein. The illustrated memory stores data files, an operating system (OS), and a mobile application. It is noted that any other suitable information and/or software can be stored in the processor and/or memory. The at least one processor can be of any suitable type. The at least one IO interface can be of any suitable type such as a keyboard, a mouse, a track ball, a touch pad, a camera, a speaker, a touch screen, and the like. The network interface can be of any suitable type such as, for example but not limited to, a network interface card, software simulating a network card, and the like. The illustrated processor and memory are programmed with the mobile app or application for communicating with the web portal of the service provider server as described in more detail hereinafter. The terms "mobile app" and "mobile application" are used in the specification and claims to mean a type of application software designed to run on a mobile electronic device 38 to provide users with similar services to those accessed on personal computers.

Figure 4:
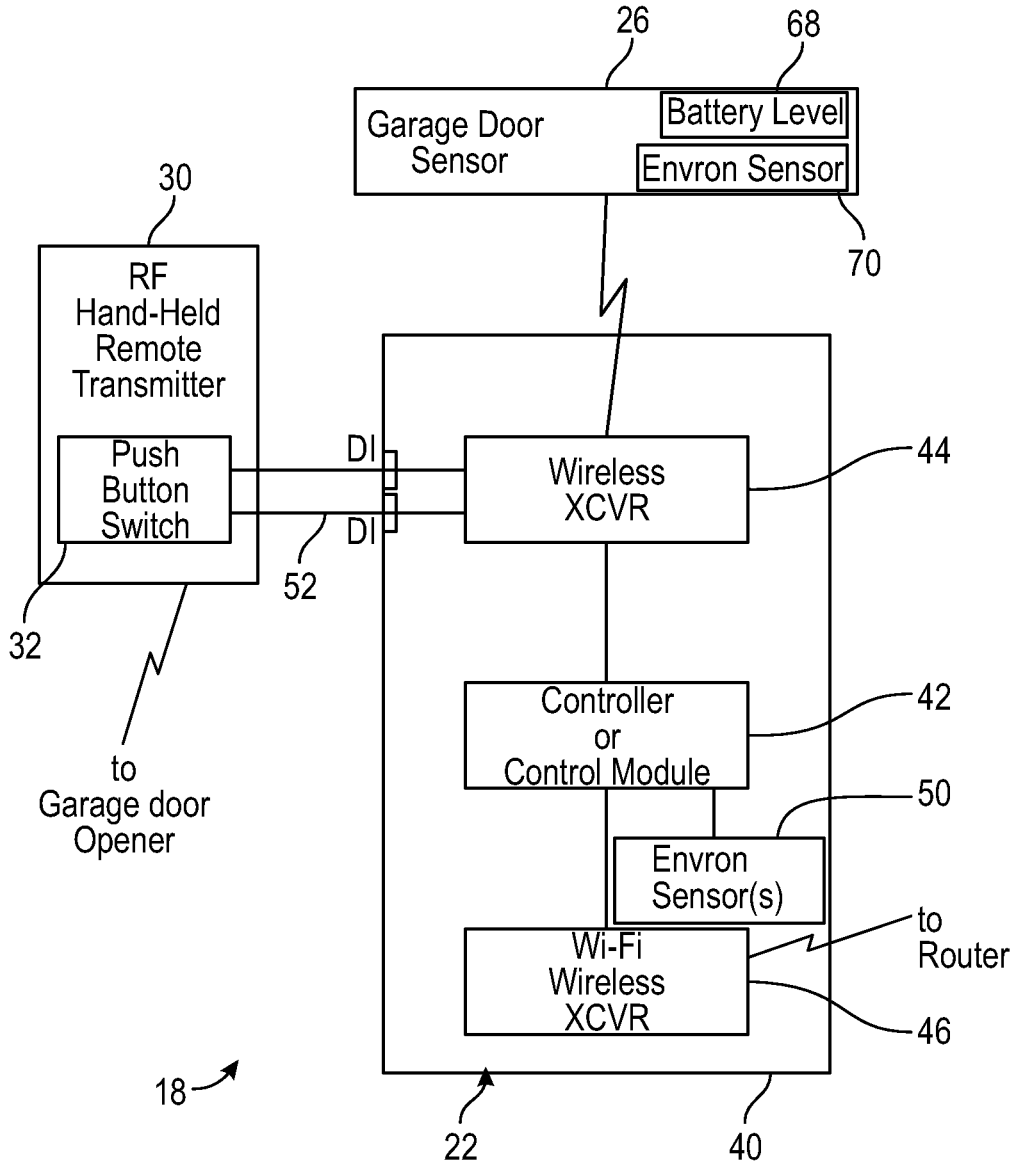
FIG. 4 is a schematic view of a main module of the universal add-on system of FIGS. 2 and 3 according to a first embodiment of the disclosure.

FIG. 4 illustrates the universal add-on system 18 according to a first embodiment of the disclosure. The universal add-on system 18 includes the universal add-on main module or device 22 configured to communicate with the communication network 24 and the least one door position sensor 26 mountable to monitor open and closed door status of the garage door 28.

Figure 5:
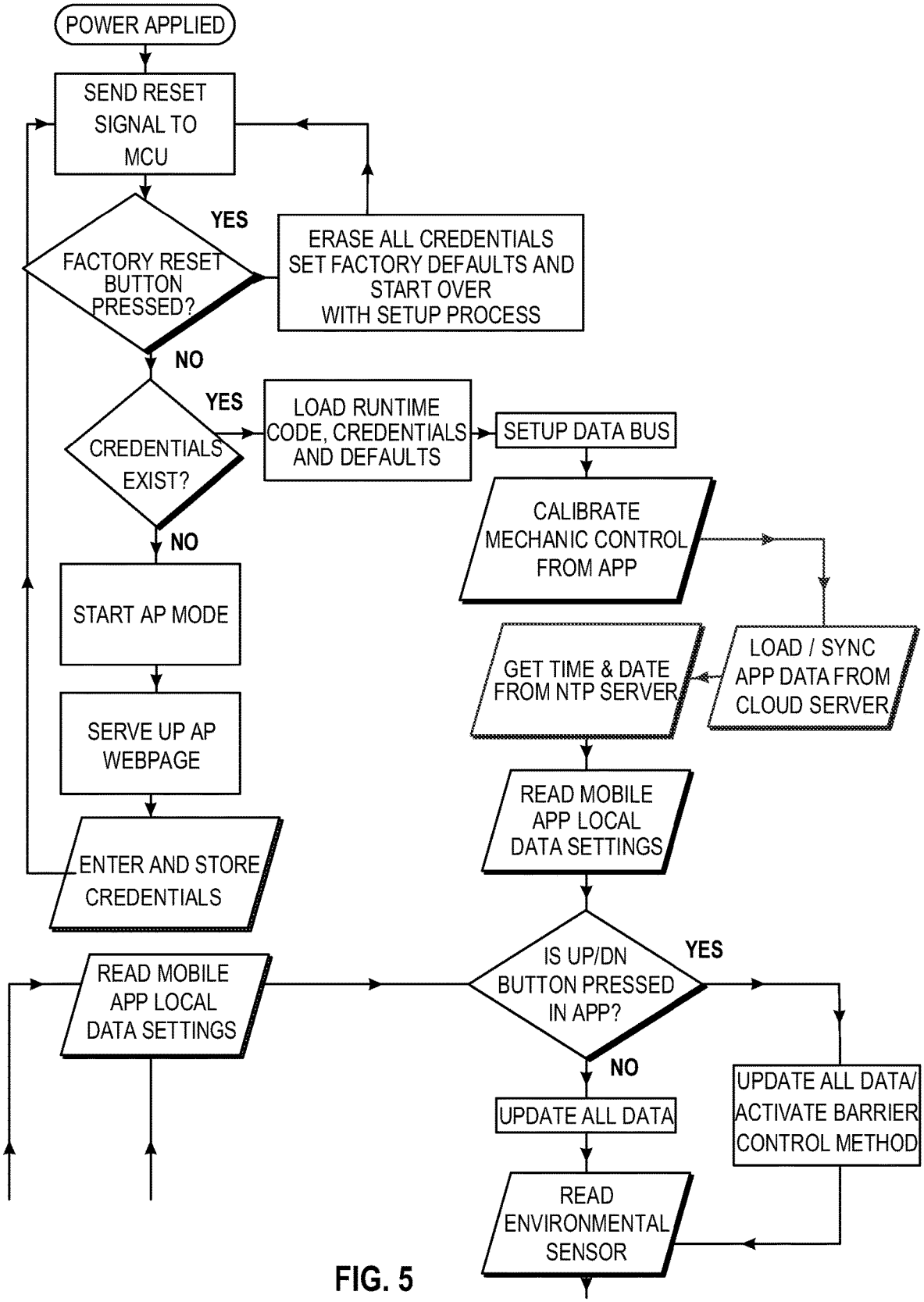
FIG. 5 is a first portion of a flow chart showing operation of a control module of the main module of FIG. 4.
Figure 6:
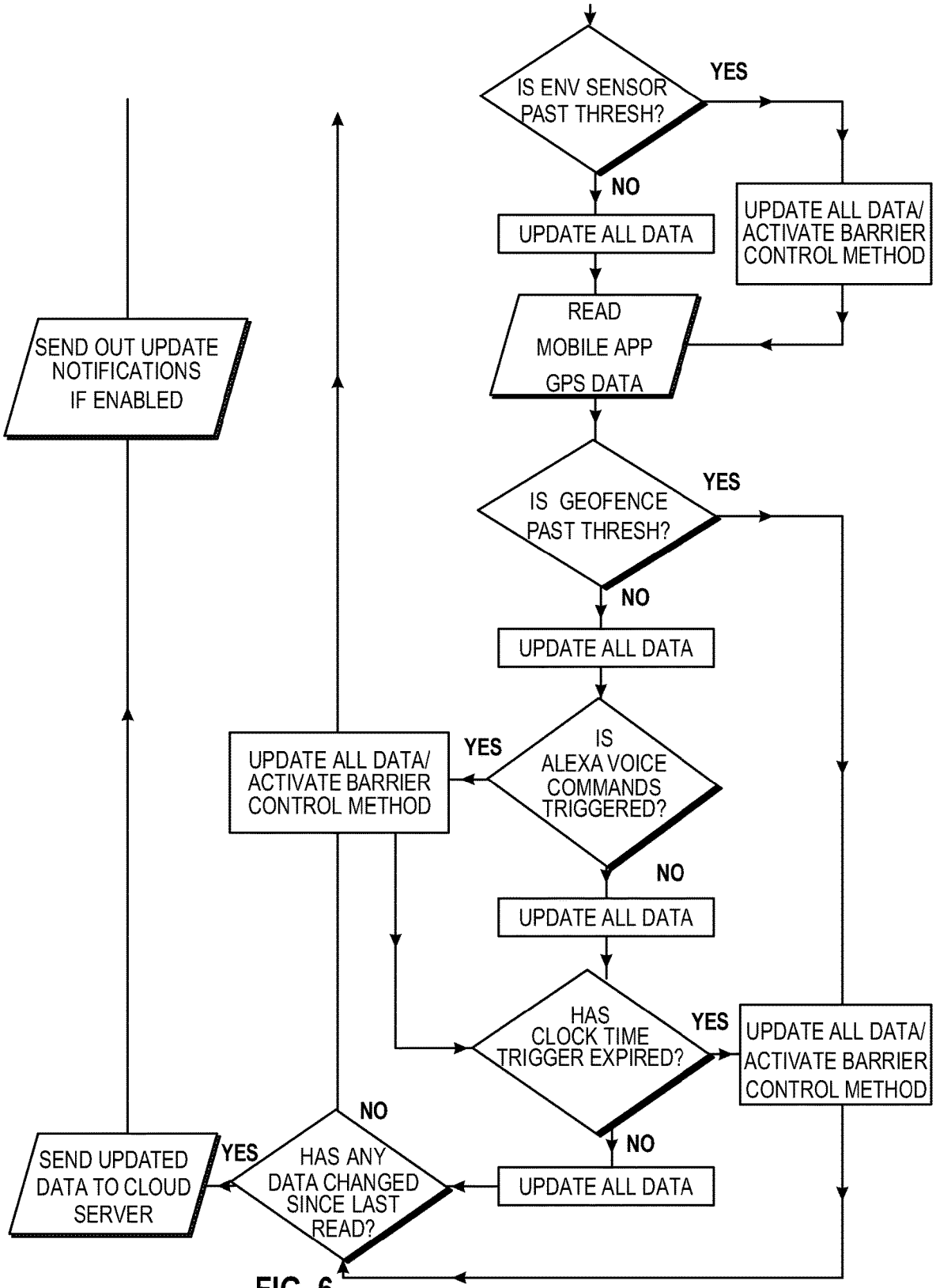
FIG. 6 is a second portion of the flow chart of FIG. 5.

The illustrated universal add-on device 22 includes a housing 40, a controller or control module 42, located within the housing 40, a first wireless transceiver 44 located within the housing 40 for communication with the door position sensor 26, a second wireless transceiver 46 located with the housing 40 for communication with the communications network 24 via a router 48, and at least one environmental sensor 50 located within the housing 52 for sensing an environmental condition as described in more detail hereinafter. The illustrated control module 42 is in electrical communication with the RF hand-held remote transmitter 30 by a wired connection 52 to the normally-open push-button relay or switch 32 so that the switch 32. The wired connection 52 with the control module 42 is in parallel with the push button 34 so that the normally-open push-button relay or switch 32 can be selectively closed by either manually pushing the push button 34 or electrically by the control module 42 to activate the garage door opener 20 via the RF hand-held remote transmitter to either open or close the garage door 28. The illustrated control module 42 includes a suitable microprocessor and memory programmed with software and/or firmware to perform the functions described herein. FIGS. 5 and 6 illustrate a flow chart for operation of the control module 42. It is noted that the control module 42 can alternatively operate in any other suitable manner.

The illustrated control module 42 is also in bi-directional communication with the wireless transceiver 46 to wirelessly transmit and receive information, via the router 48 and the communication network 24, to and from the service provider server(s) 36. The illustrated control module 42 is wired to the wireless transceiver 46. The router 48 is a conventional router and can be any suitable router located at the home or business. The wireless connection between the control module 42 and the router 48 can be of any suitable type such as, for example but not limited to, Wi-Fi, or other the like, and can alternatively be a wired connection if desired. It should be noted that the Wi-Fi control unit can also be controlled via voice commands over the network from Alexa, Google home assistant, and the like. It should also be noted that the control unit 42 and/or any other wireless device used in this ecosystem preferably uses at least one form of data encryption locally and/or remotely. As discussed above, the router 48 is in bidirectional wireless communication with the service provider server(s) 36 via the communications network 24. The service provider server(s) 36 is designated to provide functions of the system 18 in bidirectional wireless communication with a user's mobile electronic device 38.

The illustrated control module 42 is also in communication with the at least one door position sensor 26 to receive the door position status information from the door position sensor 26 which in turn sends the door position status information to the service provider server(s) 36 via the first wireless transceiver 46, the router 48, and the communications network 24. The illustrated control module 42 is in wireless communication with the door position sensor 26 via the first wireless transceiver 44. This wireless connection can be, for example but not limited to, Bluetooth, BLE, Wi-Fi, Zigbee, Z-Wave, DECT 6.0, spread spectrum RF, proprietary RF, infra-red, or the like. It is noted that the door position sensor 26 can alternatively be in communication with the control module 42 in any other suitable manner as discussed in more detail hereinbelow.

Figure 4A:
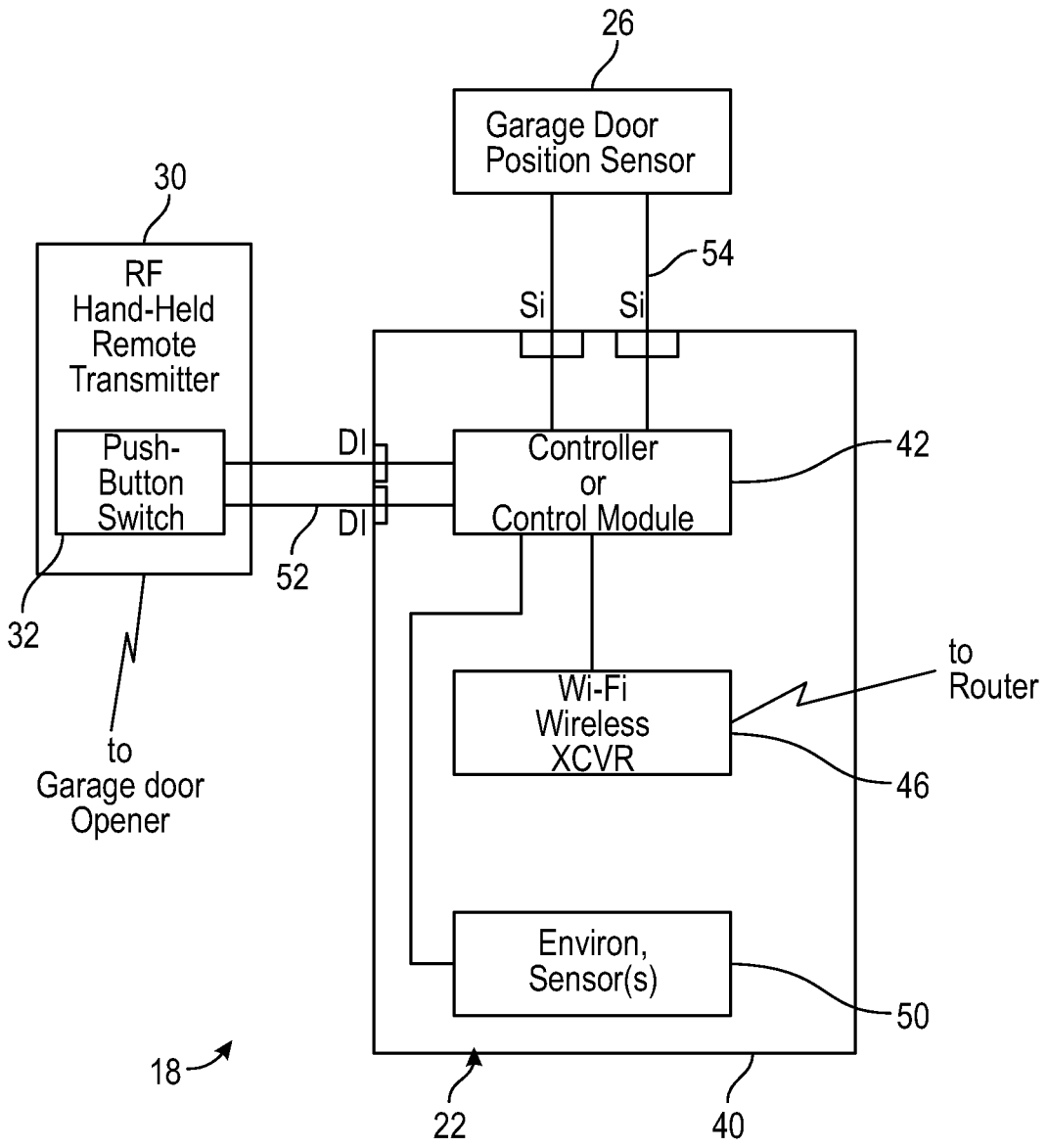
FIG. 4A is a schematic view of a main module of the universal add-on device system of FIGS. 2 and 3 according to a first variation of the first embodiment of the disclosure.

FIG. 4A illustrates a first variation of the first embodiment of the disclosure shown in FIG. 4 and is substantially the same as the first embodiment of the disclosure shown in FIG. 4 except that the door position sensor 26 is directly in communication with the control module 42 with a wired connection 54 to send door position status information to the control module 42. In this first variation, the first wireless transceiver 44 within the housing 40 can be eliminated. This first variation of the first embodiment of the disclosure shows that other suitable connections can be provided for the door position sensor 36.

Figure 4B:
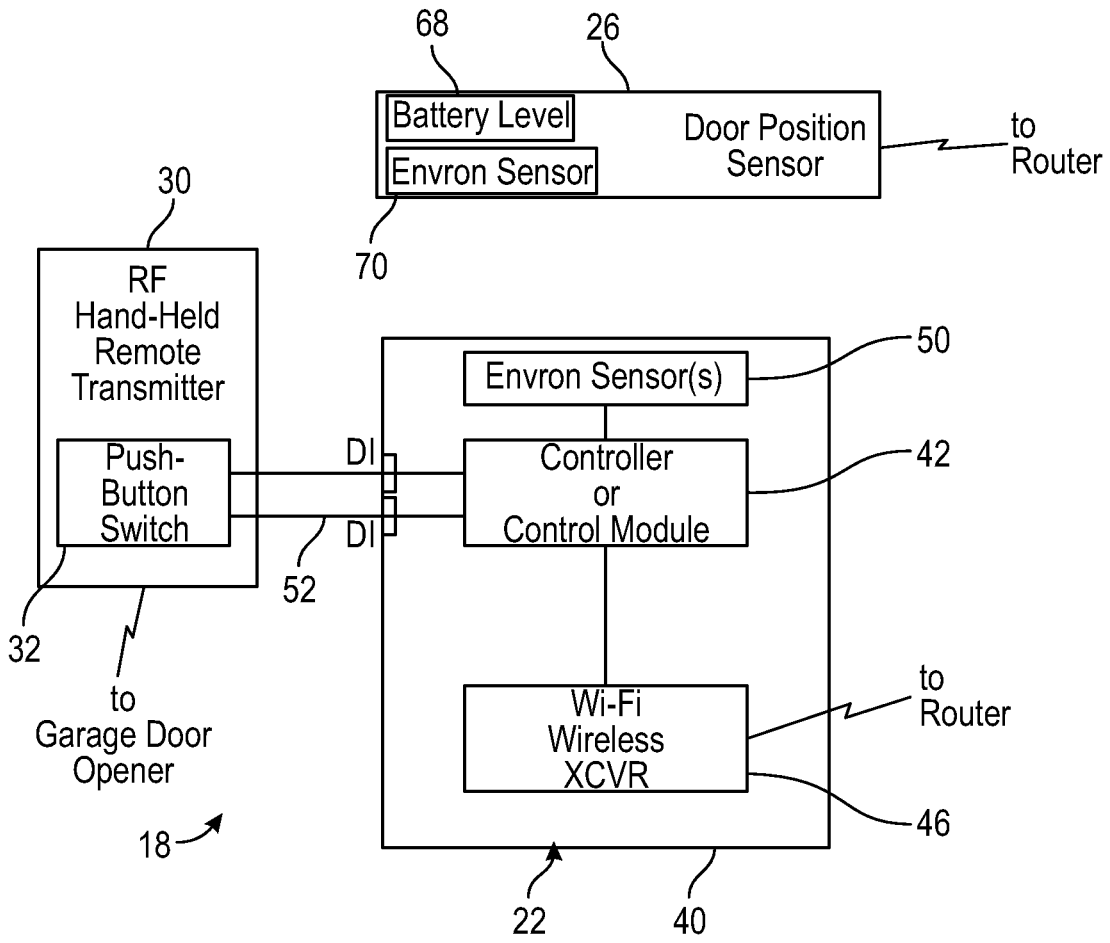
FIG. 4B is a schematic view of a main module of the universal add-on system of FIGS. 2 and 3 according to a second variation of the first embodiment of the disclosure.

FIG. 4B illustrates a second variation of the first embodiment of the disclosure shown in FIG. 4 and is substantially the same as the first embodiment of the disclosure shown in FIG. 4 is except that the door position sensor 26 is directly in communication with the router 48 via a wireless connection to send the door position status information to the service provider server(s) 36 via the communications network 24. This wireless connection can be, for example but not limited to, Wi-Fi, or the like. In this second variation, the first wireless transceiver 44 within the housing 40 can again be eliminated and the door position sensor is provided with a Wi-Fi transceiver or the like. This second variation of the first embodiment of the disclosure also shows that other suitable connections can be provided for the door position sensor 26.

The illustrated control module 42 is also in communication with the at least one environmental sensor 50 located within the housing 40. The at least one environmental sensor 50 can include a water sensor, a humidity sensor, a temperature sensor, a pressure sensor, a VOC sensor, and/or any combination thereof. Each of the environmental sensors 50 monitor an environmental condition within the garage, and the data is sent to the control module 42. If certain predetermined levels are present or indicate a dangerous situation is present (such as, for example but not limited to, flooding, dangerous temperature, fire, a car running with the door closed, and the like), an alert is sent to the user's mobile electronic device 38 and/or the garage door 28 is moved until the situation is corrected. It is noted that the at least one environmental sensor 50 can be eliminated if desired.

Figure 7:
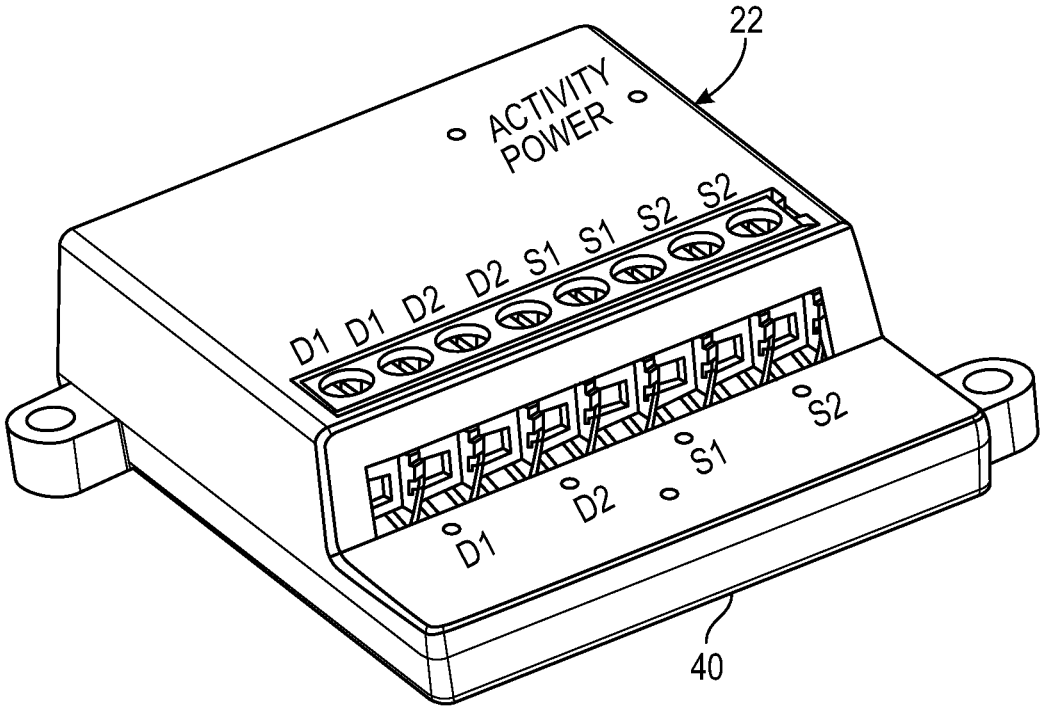
FIG. 7 is a perspective view of the control module of FIG. 4.
Figure 8:
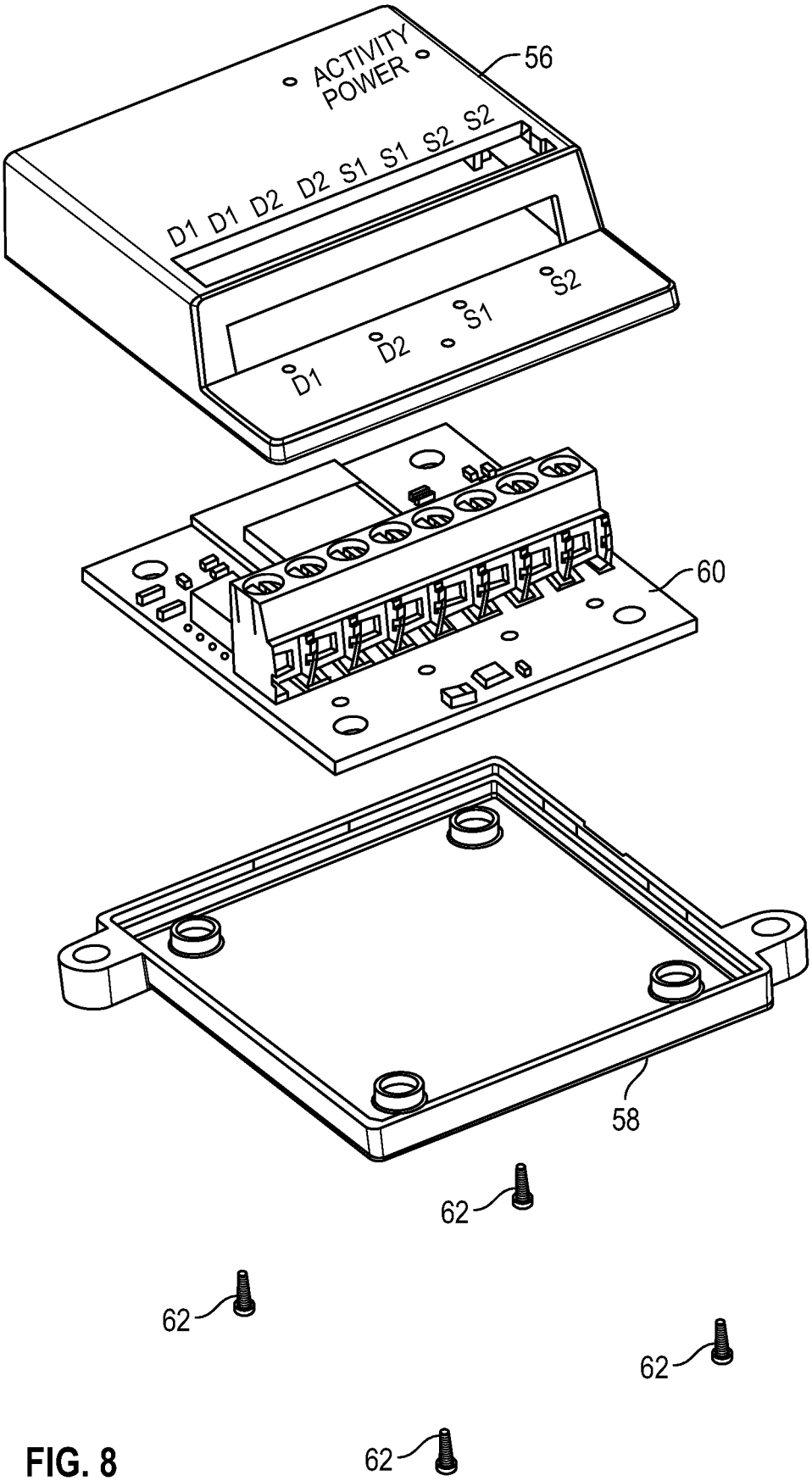
FIG. 8 is an exploded view of the control module of FIG. 7.

As shown in FIGS. 7 and 8, the illustrated housing 40 includes a top portion 56 and a bottom portion 58 that together enclose at least one circuit board 60 therein. The illustrated top and bottom portions 56, 58 of the housing 40 are secured together with mechanical fasteners 62 but can alternatively be secured together in any other suitable manner such as, for example but not limited to, a snap-fit connection and the like. The illustrated control module 42 and second wireless transceiver 46 are each provided on the circuit board 60. The illustrated circuit board 60 provides four connectors (D1, D1, D2, D2) for wired connections 52 to the push button switches 32 of two the hand-held remote transmitters 30 and four connectors (S1, S1, S2, S2) for the 54 wired connections to two of the door position sensors (when a wired connection is utilized). While this illustrated configuration can be utilized with a garage having two garage doors 28 with two garage door openers 20, it is noted that other configurations can alternatively be utilized for use with a single garage door opener 20 or more than two garage door openers 20. It is noted that the housing 40 can alternatively have any other suitable configuration. For example but not limited to, with the illustrated housing 40, the RF hand-held remote transmitter 30 is located outside the housing 40 but it is noted the housing 40 can alternatively be configured so that the RF hand-held remote transmitter 30 is located within the housing 40 (as shown below in the second embodiment of the disclosure hereinbelow).

When the door position sensor 26 has a wireless connection with the control module 42, the housing 40 can be mounted in any suitable location which enables (1) a wireless connection between the control module 42 and the router 48, (2) an RF connection between the hand-held remote transmitter 30 and the garage door opener 20, and (3) a wireless connection between the door position sensor 26 and the control module 42. Such as, for example but not limited to, the housing 40 can be mounted on an inside wall of the garage at a level conveniently accessed by the homeowner. When so mounted, it can be placed in parallel with a conventional push-button wall console 64 or, if desired, the push button control can be added to the control module 42, thus enabling the assembly to serve both the function of a user-actuated attended door opener, as well as the herein described feature enhancement of operation via a mobile electronic device 38. This position can also be utilized when the door position sensor 26 has either wired connection with the control module 42 or a direct wireless connection with the router 48. When the door position sensor 26 has the wired connection 54 with the control module 42, the housing 40 can be mounted near the garage door opener 20 or any other suitable location which enables (1) a wired connection 54 between the control module 42 and the door position sensor 26, (2) an RF connection between the hand-held remote transmitter 30 and the garage door opener 20, and (3) a wireless connection between the control module 42 and the router 48. When the door position sensor 26 has a wireless connection directly with the router 48, the housing 40 can be mounted near the garage door opener 20 or any other suitable location which enables (1) a wireless connection between the door position sensor 26 and the router 48, (2) an RF connection between the hand-held remote transmitter 30 and the garage door opener 20, and (3) a wireless connection between the control module 42 and the router 48.

Figure 9:
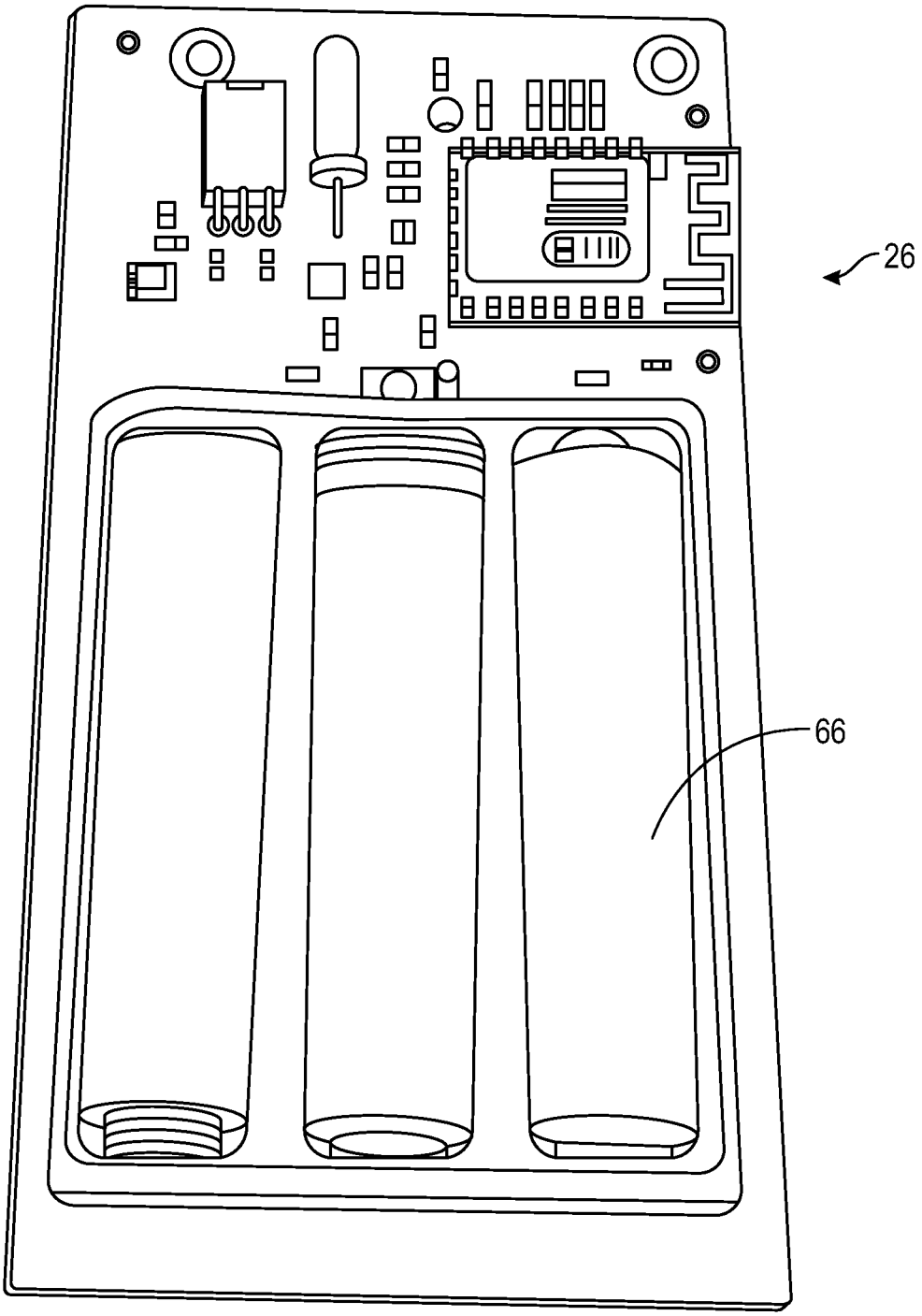
FIG. 9 is a perspective views of a door position detector of the universal add-on system of FIGS. 2 and 3, with a housing removed for clarity.
Figure 10:
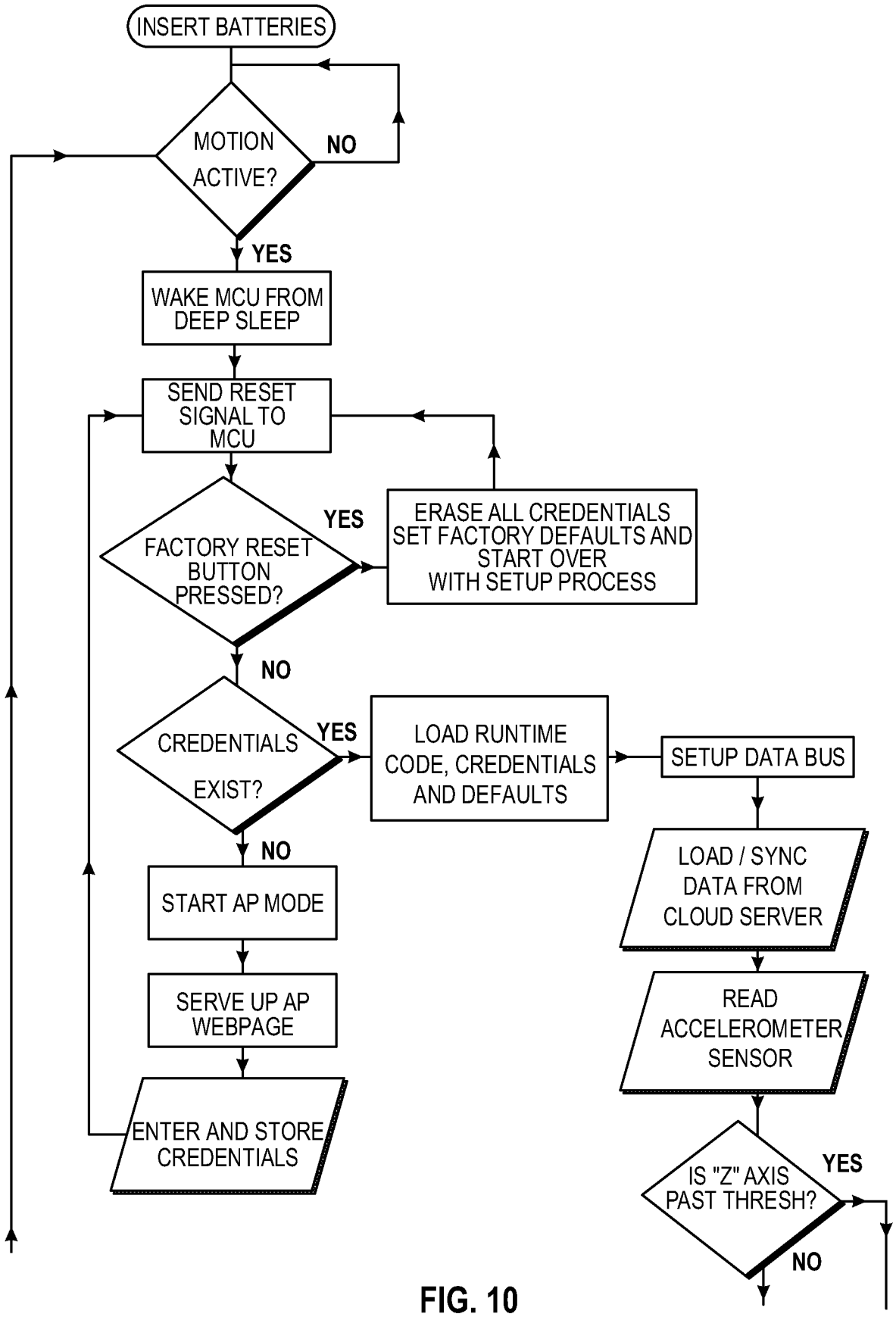
FIG. 10 is a first portion of a flow chart showing operation of the door position detector of FIG. 9.
Figure 11:
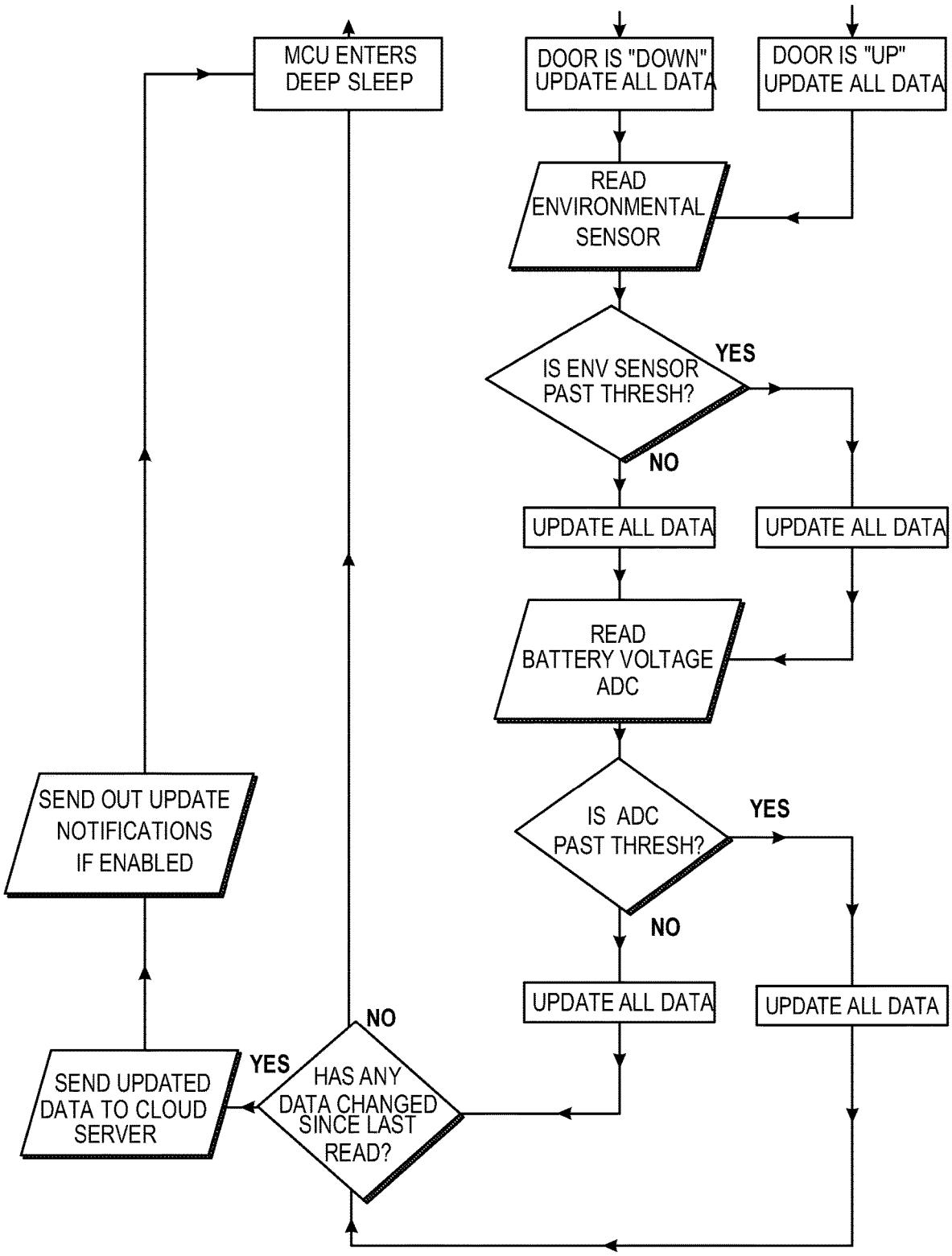
FIG. 11 is a second portion of the flow chart of FIG. 10.

The illustrated wireless door position sensor 26 is configured to be physically located on the garage door 28 in order to determine whether the garage door 28 is in the open position or the closed position. The illustrated door position sensor 26 is an accelerometer-type position detector to be secured to an inner side of the garage door 28. The wireless door position sensor 26 uses an algorithm on the accelerometer's z-axis to determine the open (horizontal) or closed (vertical) state of the door due to gravity change of direction on the accelerometer's z-axis. It is noted that the door position sensor 26 can alternatively be of any other suitable type such as, for example but not limited to, magnetic, infrared, tilt, ultrasonic, and the like. It is also noted that the door position sensor 26 can alternatively be located at any other suitable location at or near the garage door 28. The door position sensor 26 can be secured in any suitable manner such as, for example but not limited to, fasteners, adhesive, double-back adhesive tape, and the like. The illustrated door position sensor is powered by one or more batteries 66 (best shown in FIG. 9) such as, for example but not limited to, primary alkaline batteries and the like. It is noted that the door position sensor can alternatively be powered in any other suitable manner such as, for example but not limited to, rechargeable batteries. Additionally, a micro USB port or the like for recharging the rechargeable batteries can be provided if desired. The illustrated door position sensor 26 is also configured to provide battery charge level data 68 to the control module 42 (or directly to the service provider server(s) 36). If the battery charge level drops below a preset level, an alert is sent to the user's mobile electronic device 38 so that the user can recharge or replace the batteries 66 before the door position sensor 26 is no longer operating due to loss of power. The illustrated door position sensor 26 includes a suitable microprocessor and memory programmed with software and/or firmware to perform the functions described herein. FIGS. 10 and 11 illustrate a flow chart for operation of the door position sensor 26. It is noted that the door position sensor 26 can alternatively be configured in and/or operate in any other suitable manner.

The illustrated battery-powered and wireless door sensor 26 also includes at least one environmental sensor 70. The at least one environmental sensor 70 can include a water sensor, a humidity sensor, a temperature sensor, a pressure sensor, a VOC sensor, and/or any combination thereof. Each of the environmental sensors 70 monitor an environmental condition within the garage, and the data is sent to the control module 42 (or directly to the service provider server(s) 36). If certain predetermined levels are present or indicate a dangerous situation is present (such as, for example but not limited to, flooding, dangerous temperature, fire, a car running with the door closed, and the like), an alert is sent to the user's mobile electronic device 38 and/or the garage door 28 is appropriately moved or maintained until the situation is corrected. It is noted that the environment sensor 70 can be eliminated in desired.

It is noted that the illustrated wireless battery-powered door sensor 26 can also be used in applications other than monitoring the open/closed status of a barrier such as, for example but not limited to, the illustrated garage door 20. Additional door position sensors 26 can be purchased and used for different applications around the house. For example, with auto wake-up enabled, the door position sensor 26 with a water sensor can be used near a sump pump or elsewhere in a basement to detect water. It could also be used under a sink, near a toilet, near a water heater etc.

It is also noted that when the door position sensor 26 is connected to the control module with a wired connection 54 (as illustrated in FIG. 4A of the first variation of the first embodiment of the disclosure), the door position sensor 26 is preferably a reed-style switch located on or near a frame of the garage door 28 that is triggered by the presence of a magnet secured to the side of the garage door 28 and the door position sensor 26 is preferably not provided with any environmental sensors 70. Thus, the door position sensor 26 does not require power and the batteries 66 can be eliminated.

During operation of the system 18, the garage door open and closed status is monitored by the door position sensor 26 and is transmitted to the control module 42 (see FIGS. 4 and 4A). The control module 42 then wirelessly transmits this monitored door status information to the service provider server(s) 36. As indicated above, alternatively, the door position sensor can directly transmit the information to the service provider server(s) 36 via the router 48 and the communications network 24 (see FIG. 4B). The service provider server(s) 36 subsequently wirelessly transmits the door open and closed status information to the user's mobile electronic device 38 for viewing by the user.

The transmission of the door open and closed status information from the door position sensor 26 to the control module 42 (or directly to the router 48) occurs whenever there is a change of door open and closed status, and/or in accordance with any other a pre-established procedure such as, for example but not limited to, a periodic pulse, open request, and the like. The door position sensor 26 is typically in a sleep state and is activated or "woken up" by movement to transmit all sensor status and then goes back to sleep mode. Pre-set wake-up intervals can be programmed into the door position sensor 26 through the mobile app to "Auto wake-up" with no movement necessary. This programs an internal clock timer in the door position sensor 26. It allows for reading and transmitting all environmental sensor data one, or twice (or more) per hour upon auto wake-up etc., even if the door has not moved. The transmitted door open and closed status data and environmental sensor data is stored in the designated service provider server(s) 36 and is subsequently transmitted to the user's mobile electronic device 38 when desired.

If the door open and closed status is desired to be changed by the user, the user's mobile electronic device 38 wirelessly transmits a change of status command (e.g., close an open door, or open a closed door) in the reverse direction, via the communications network 24 to the router 48, and thereafter to the control module 42 which activates the door opener 20 to toggle its associated garage door 20 in accordance with the transmitted change of status command.

To provide for carrying out of the change of door status instruction, the control module 42 closes the normally-open relay or switch 32 of the RF hand-held remote transmitter 30. The closed relay or switch 32 causes the RF hand-held remote transmitter 30 to wirelessly send a command to the door opener 20 to close a normally open relay or switch within the garage door opener 20 which activates the garage door opener 20 to carry out the command and move the garage door 28, for example by either opening the garage door 28, if closed, or closing the garage door 28, if open.

Figure 12:
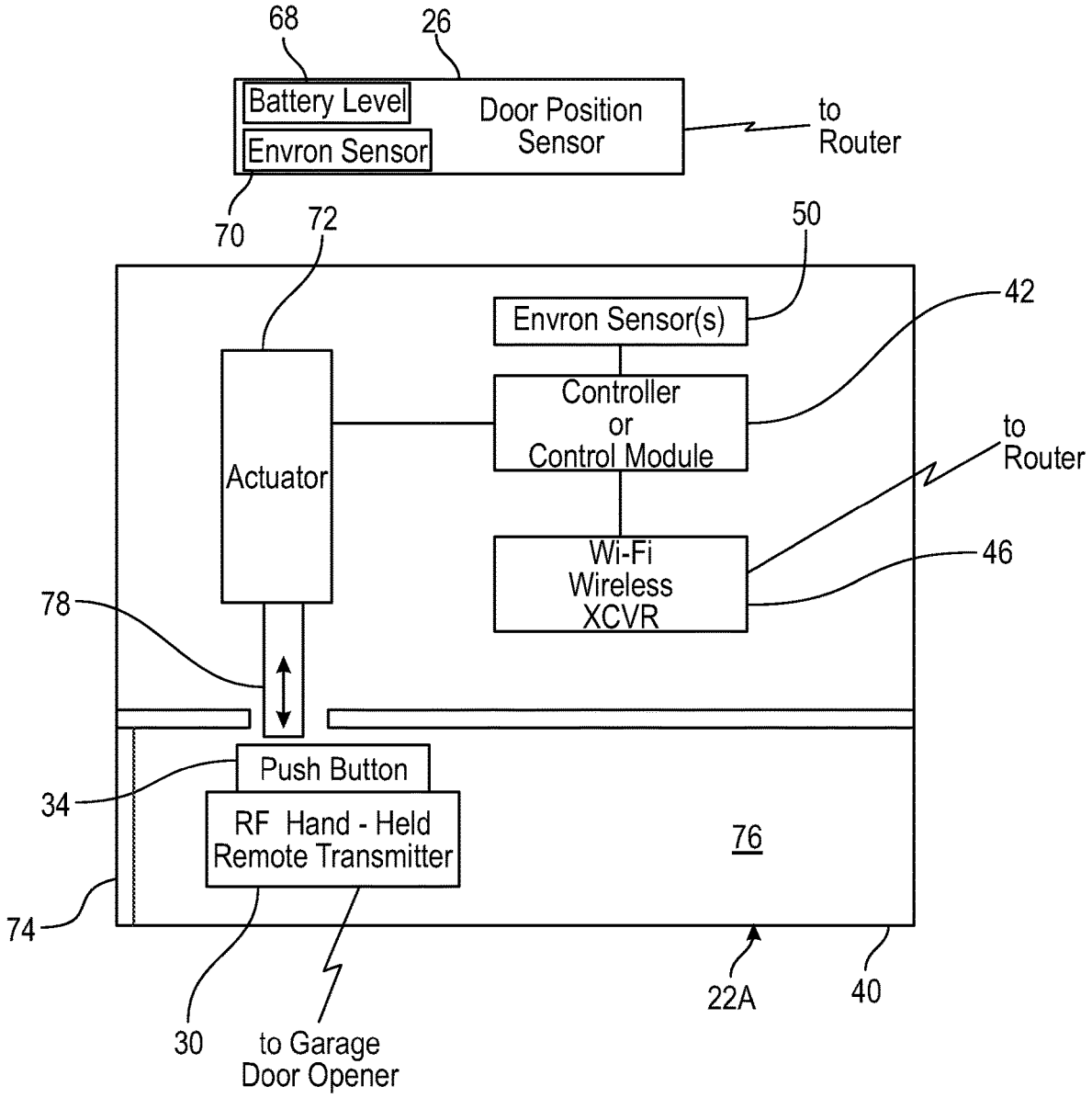
FIG. 12 is a schematic view of a main module of the universal add-on system of FIGS. 2 and 3 according to a second embodiment of the disclosure.

FIG. 12 shows a universal add-on device 22A for feature enhancement of a garage door opener 20 according to a second embodiment of the disclosure. The universal add-on device 22A according to the second embodiment is substantially the same as the first embodiment disclosed above except that the RF hand-held remote transmitter 30 is located within the housing 40 and the control module 42 selectively activates the hand-held remote transmitter 30 via an actuator 72 that physically depresses the push-button 34 of the RF hand-held remote transmitter 30 rather than utilizing the wired connection 54 with the RF hand-held remote transmitter 30 discussed hereinabove with regard to the first embodiment of the disclosure.

Figure 12A:
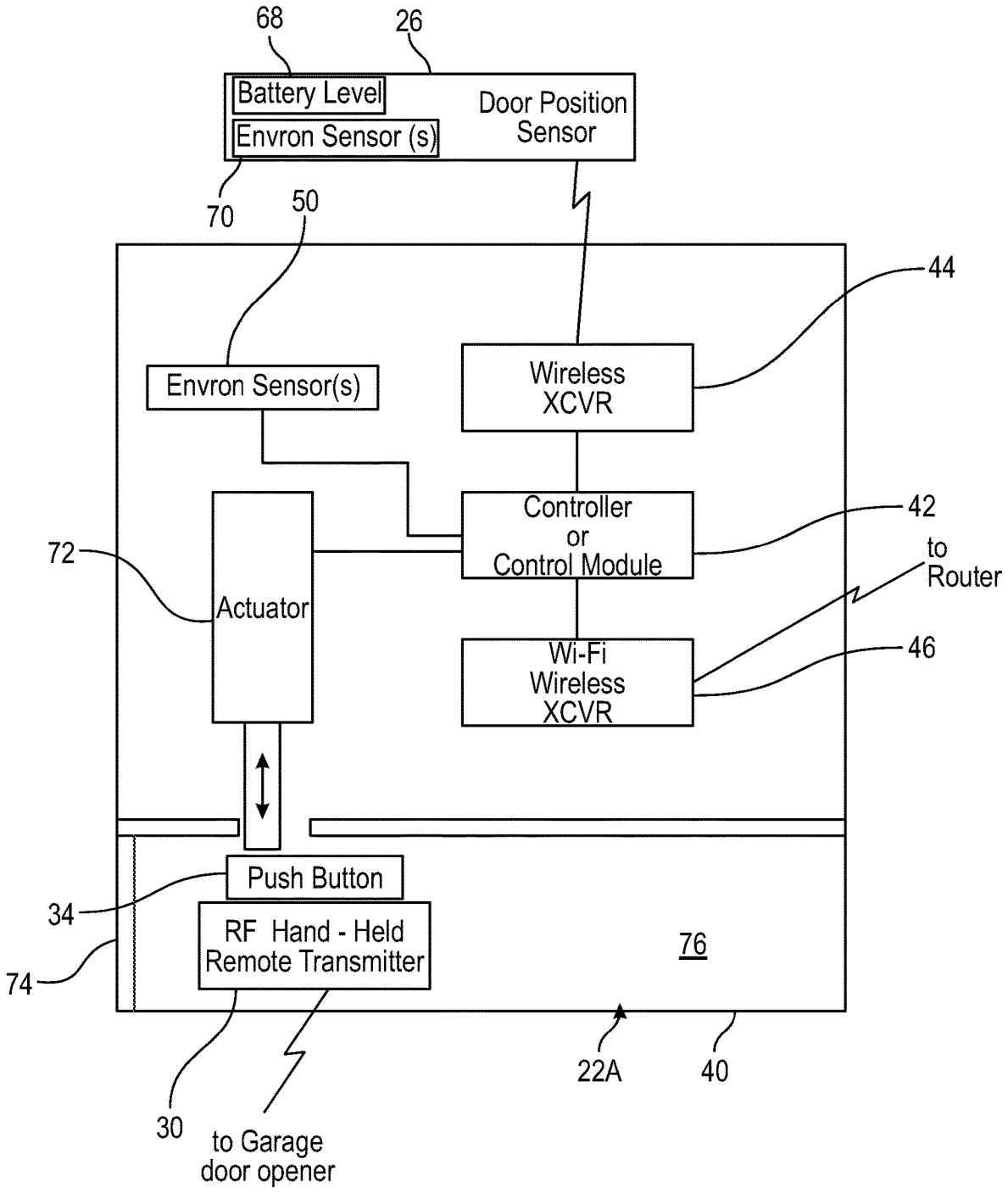
FIG. 12A is a schematic view of a main module of the universal add-on device system of FIGS. 2 and 3 according to a first variation of the second embodiment of the disclosure.
Figure 12B:
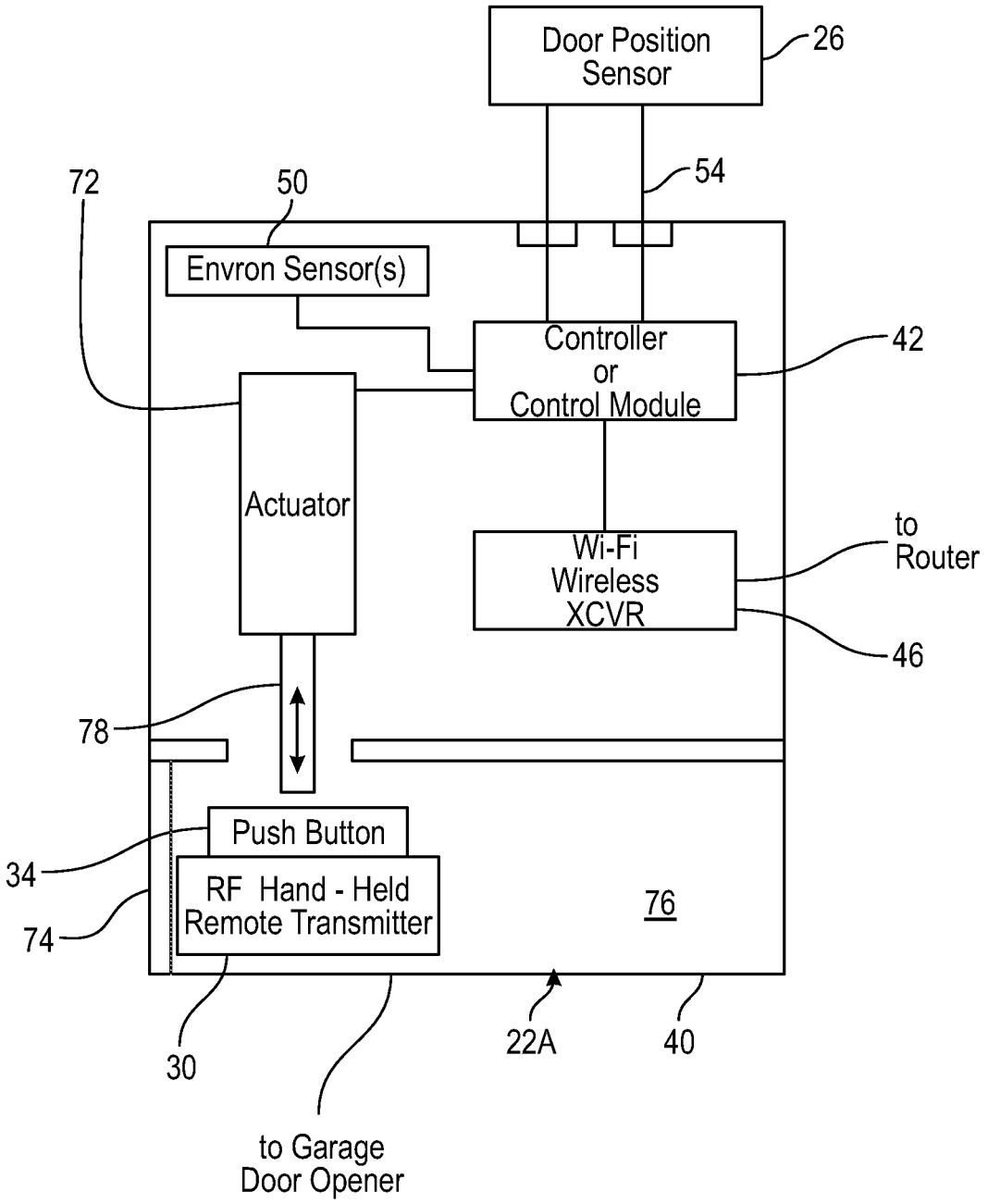
FIG. 12B is a schematic view of a main module of the universal add-on system of FIGS. 2 and 3 according to a second variation of the second embodiment of the disclosure.

The illustrated at least one door position sensor 26 is in communication with the router 48 via a wireless connection such as, for example but not limited to, Wi-Fi, or the like. It is noted that the door position sensor 26 can alternatively be in communication with the control module 42 via a wireless connection such as, for example but not limited to, Bluetooth, BLE, Wi-Fi, Zigbee, Z-Wave, DECT 6.0, spread spectrum RF, proprietary RF, infra-red, or the like (see FIG. 12B). It is also noted that the door position sensor can alternatively be in communication with the control module 42 via a wireless connection (see FIG. 12A).

The illustrated actuator 72 is operably in communication with the control module 42 and is located within the housing 40. The RF hand-held remote transmitter 30 is also located within the housing 40 and the housing 40 is provided with a door 74 for insertion and removal of the RF hand-held remote transmitter 74 into and out of an interior cavity 76 for the RF hand-held remote transmitter 30. The illustrated actuator 72 is a linear actuator having an engagement member 78 that is selectively extended and retracted in a substantially linear manner to depress release the push-button 34 of the RF hand-held remote transmitter 30. It is noted that the actuator 72 can include, for example but not limited to, an electric solenoid, a mechanical actuator, a hydraulic actuator, a pneumatic actuator, a piezoelectric actuator, a twisted and coiled polymer actuator, an electromechanical actuator, a linear motor, a telescopic linear actuator, or the like. The actuator 72 is configured and positioned to provide enough stroke and force to depress and release the push button 34 of the push-button switch 32. It is noted that any other suitable actuator 72 configuration can alternatively be utilized.

Figure 12C:
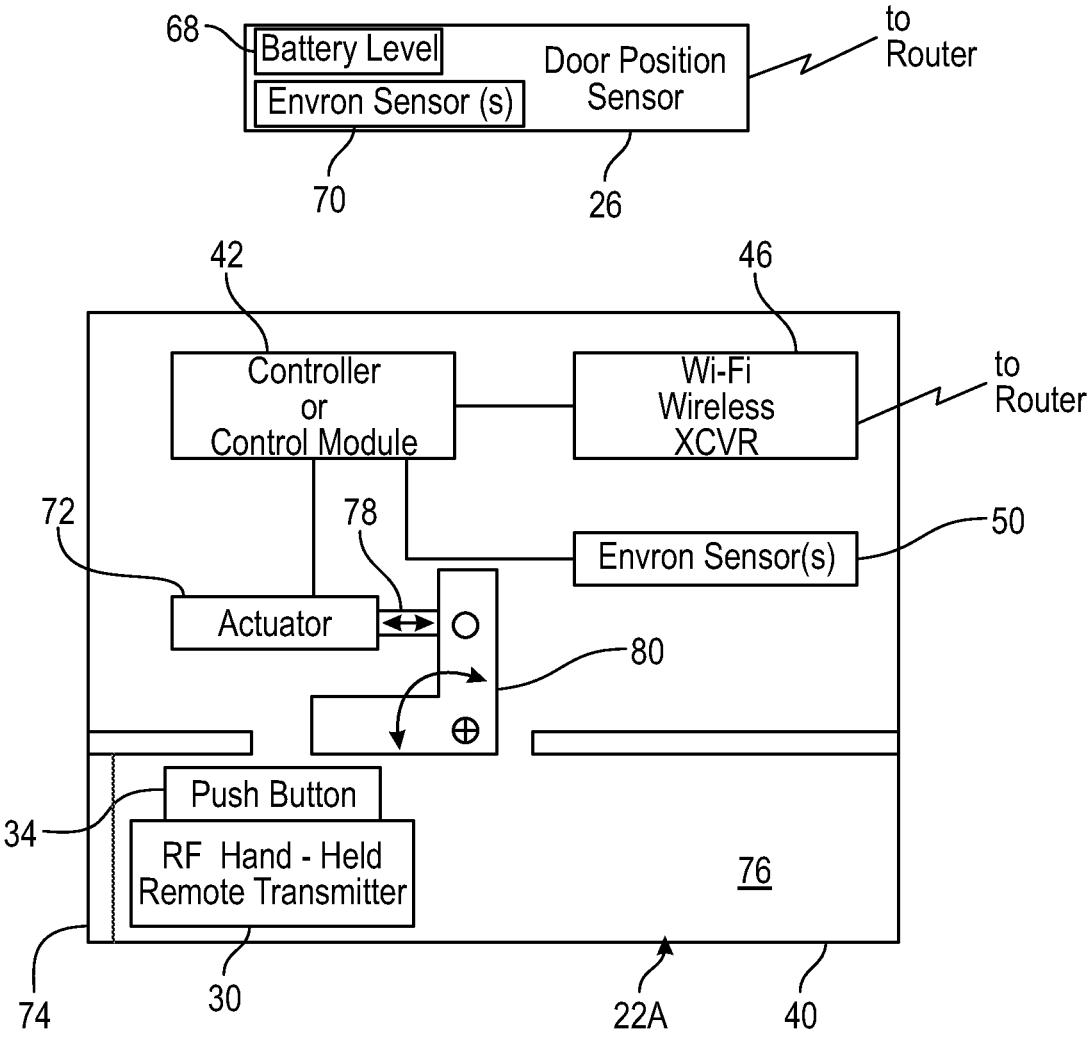
FIG. 12C is a schematic view of a main module of the universal add-on system of FIGS. 2 and 3 according to a third variation of the second embodiment of the disclosure.

FIG. 12C illustrates a third variation of the add-on device 22A according to the second embodiment which shows that the actuator 72 can also have any other suitable configurations such as, for example but not limited to, the actuator 72 can include a pivoting arm 80 that engages the push button 34 of the hand-held remote transmitter 30. The actuator 72 is preferably provided with means for adjusting its position relative to the push-button 34 of the hand-held remote transmitter 30. It is noted that any other suitable actuator 72 configuration can alternatively be utilized.

Figure 12D:
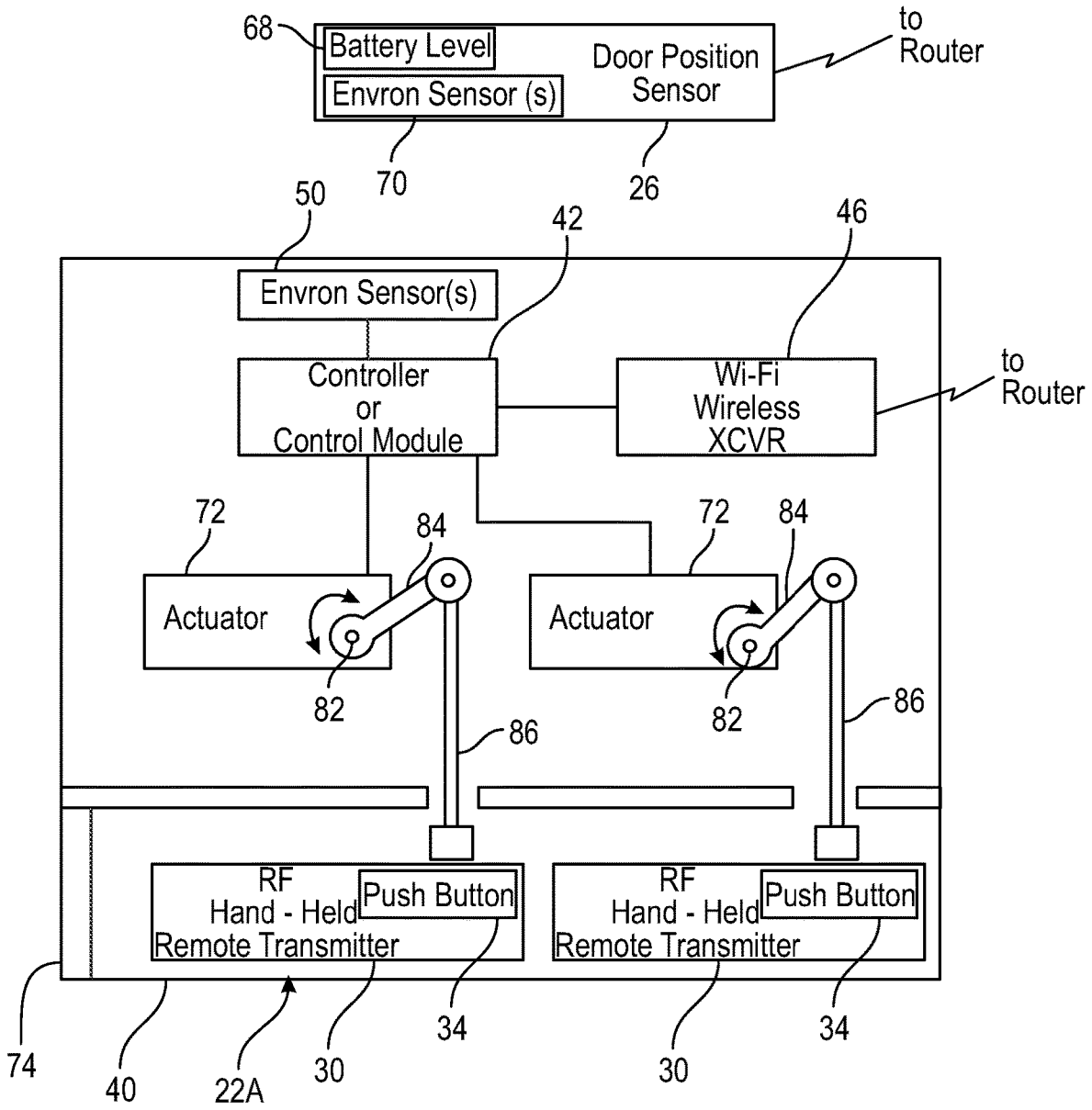
FIG. 12D is a schematic view of a main module of the universal add-on system of FIGS. 2 and 3 according to a fourth variation of the second embodiment of the disclosure.
Figure 13:
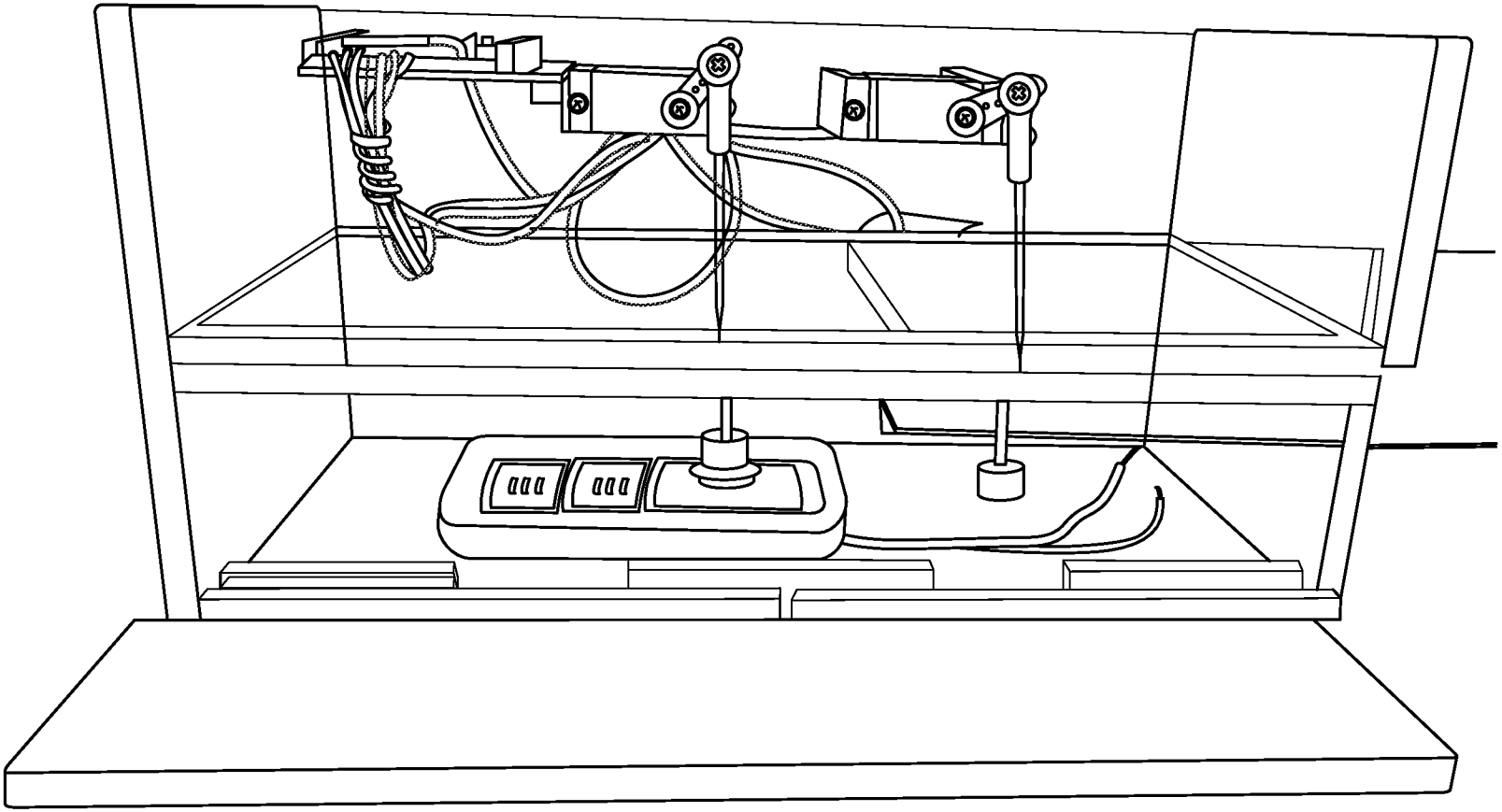
FIG. 13 is a perspective view of an exemplary main module of FIG. 12D.

FIG. 12D illustrates a fourth variation of the add-on device 22A according to the second embodiment of the disclosure which illustrates that the actuator 72 can have any other suitable configuration. The illustrated actuator 72 includes a rotational servo 82 which selectively rotates an arm 84 about one end to move an engagement member 86 secured to the opposite end in a generally linear manner to depress and release the push-button 34 of the RF hand-held remote transmitter 30. It is noted that any other suitable actuator 72 configuration can alternatively be utilized.

The device according to the second embodiment of the disclosure also illustrates that two or more actuators 72 can be provided when the add-on device 22A is designed to be utilized with two or more garage doors 28. Two actuators 72 can be utilized to selectively actuate two different push-buttons 34 of a single RF hand-held remote transmitter 30 having two or more push buttons 34 or to selectively actuate push-buttons 34 of a two separate RF hand-held remote transmitters 30 each having one or more push buttons 34. While this configuration can be utilized with two garage door openers 20, it is noted that any of the illustrated configurations can be configured for use with a single garage door opener 20 or two or more garage door openers 20.

In addition to the above-described features of monitoring open and close status, environmental conditions, and battery level, and activating a change of status via a user's mobile electronic device 38, any other suitable additional features can be added by the universal add-on devices 22, 22A if desired. Such additional features can include the ability for the user to set times at which the garage door should be opened (such as the arrival of kids from school) or closed (such as at night), and/or GeoFence. The GeoFence feature utilizes GPS information of the user's mobile electronic device 38 to automatically close the garage door 28 when the mobile electronic device 38 exits a preset boundary about the garage and to automatically open the garage door 28 when the mobile electronic device 38 enters preset boundary about the garage. Additional features can also include a Wi Fi camera and/or an ambient light sensor, and the like. The Wi FI camera enables a user to see a live video stream of the garage door via the mobile app for verification of open/close/people/objects etc. The ambient light sensor can be utilized to automatically close the garage door 28 if it is open when it gets dark outside. It is noted that any other suitable features can also be added to the universal add-on devices 22, 22A.

Any of the features or attributes of the above described embodiments and variations can be used in combination with any of the other features and attributes of the above described embodiments and variations as desired.

It is apparent from the above detailed description of preferred embodiments, that the above-disclosed universal add-on devices 22, 22A can be utilized for feature enhancement of existing already-installed garage door openers 20 or feature enhancement of new "non-smart" garage door openers 20. It is additionally apparent that the universal add-on devices 22, 22A are truly universal regardless of the age of the garage door opener 20 and/or the specific wireless communication protocol utilized because the original manufacturer provided hand-held remote transmitter 30 can be utilized to communicate with the garage door opener 20. Therefore, communication and set up problems with the garage door opener 20 are eliminated.

From the foregoing disclosure and detailed description of certain preferred embodiments, it is also apparent that various modifications, additions and other alternative embodiments are possible without departing from the true scope and spirit of the invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A system for controlling a movable barrier opener that opens and closes a movable barrier, said system comprising:

a RF hand-held remote transmitter having a push-button switch configured to selectively transmit wireless RF signals from the hand-held wireless transmitter to the movable barrier opener for initiating the movable barrier opener to move the movable barrier upon physically pushing a push-button of the push-button switch of the RF hand-held remote transmitter;

an electric actuator configured to selectively physically press the push-button of the push-button switch of the RF hand-held remote transmitter to directly transmit wireless RF signals from the RF hand-held remote transmitter to the movable barrier opener to initiate the movable barrier opener to move the movable barrier; and a control module operably connected to the electric actuator to selectively initiate the electric actuator to physically press the push-button of the push-button switch of the RF hand-held remote transmitter to directly transmit wireless RF signals from the RF hand-held remote transmitter to the movable barrier opener to move the movable barrier.

2. The system according to claim 1, further comprising a position sensor for sensing a position of the movable barrier and operably in communication with the control module.

3. The system according to claim 2, wherein the position sensor includes at least one environmental condition sensor.

4. The system according to claim 2, wherein the position sensor is battery powered and is operably configured to provide battery charge level data.

5. The system according to claim 1, wherein the electric actuator is a linear actuator.

6. The system according to claim 1, wherein the electric actuator is a rotational actuator.

7. The system according to claim 6, wherein the electric actuator includes a servo motor.

8. The system according to claim 1, wherein the electric actuator includes a servo motor.

9. A system for controlling a movable barrier opener that opens and closes a movable barrier, said system comprising:

a RF hand-held remote transmitter having a push-button switch configured to selectively transmit wireless RF signals to the movable barrier opener for initiating the movable barrier opener to move the movable barrier upon physically pressing a push-button of the push-button switch of the RF hand-held remote transmitter to directly transmit wireless RF signals from the RF hand-held remote transmitter to the opener; and a control module operably connected with a wired connection to the RF hand-held remote transmitter in parallel with the push-button switch of the RF hand-held remote transmitter for selectively electrically activating the push-button switch of the RF hand-held remote transmitter with the control module to directly transmit wireless RF signals to the movable barrier opener from the RF hand held remote transmitter for initiating the movable barrier opener to move the movable barrier without physically pressing the push-button of the push-button switch of the RF hand-held remote transmitter.

10. The system according to claim 9, further comprising a position sensor for sensing a position of the movable barrier and operably in communication with the control module.

11. The system according to claim 10, wherein the position sensor includes at least one environmental condition sensor.

12. The system according to claim 10, wherein the position sensor is battery powered and is operably configured to provide battery charge level data.

* * * * *